US010920397B2

(12) United States Patent
Buchleiter et al.

(10) Patent No.: US 10,920,397 B2
(45) Date of Patent: Feb. 16, 2021

(54) NOZZLE AND VACUUM UNIT WITH AIR AND WATER

(71) Applicant: KAISER PREMIER LLC, Fort Morgan, CO (US)

(72) Inventors: Brandon R. Buchleiter, Sterling, CO (US); Marcus A. Thomas, Weldona, CO (US); Christopher R. Hall, Fort Morgan, CO (US); Daniel J. Kluesner, Thornton, CO (US); Jason E. Habrock, Fort Collins, CO (US)

(73) Assignee: KAISER PREMIER LLC, Fort Morgan, CO (US)

( * ) Notice: Subject to any disclaimer, the term of this patent is extended or adjusted under 35 U.S.C. 154(b) by 0 days.

(21) Appl. No.: 16/159,443

(22) Filed: Oct. 12, 2018

(65) Prior Publication Data

US 2019/0048557 A1 Feb. 14, 2019

Related U.S. Application Data

(63) Continuation of application No. 15/247,096, filed on Aug. 25, 2016, now Pat. No. 10,119,245.

(60) Provisional application No. 62/209,791, filed on Aug. 25, 2015.

(51) Int. Cl.

| | |
|---|---|
| ***E02F 3/88*** | (2006.01) |
| ***E02F 3/92*** | (2006.01) |
| ***E02F 5/00*** | (2006.01) |

(52) U.S. Cl.

CPC ..... *E02F 3/8825* (2013.01); *E02F 3/8891* (2013.01); *E02F 3/925* (2013.01); *E02F 5/003* (2013.01)

(58) Field of Classification Search

CPC ..... E02F 3/8891; E02F 3/925; E02F 5/003

See application file for complete search history.

(56) References Cited

U.S. PATENT DOCUMENTS

| | | | | |
|---|---|---|---|---|
| 491,748 | A | 2/1893 | Uric | |
| 1,911,008 | A | 5/1933 | Withingon | |
| 2,006,825 | A | 7/1935 | Downes | |
| 2,085,150 | A | 6/1937 | Gemeny | |
| 2,518,591 | A * | 8/1950 | Aston et al. | E21B 7/18 175/215 |

(Continued)

FOREIGN PATENT DOCUMENTS

| | | |
|---|---|---|
| CA | 2317667 | 8/2001 |
| CA | 2352619 | 2/2008 |

(Continued)

*Primary Examiner* — Tara Mayo-Pinnock

(74) *Attorney, Agent, or Firm* — Allan Watts PLLC

(57) ABSTRACT

Apparatuses that include a nozzle, vacuum units, and vacuum trucks for excavating material, for instance, around buried utility lines. Multiple embodiments include an (e.g., air and water) nozzle, for instance, that breaks up material (e.g., earth) that is picked up with vacuum. Various embodiments include vacuum, compressed air, and water systems. Various nozzles include two passageways or tubes (e.g., one inside the other), exit orifices (e.g., from each passageway), or a combination thereof. Tubes may be concentric or a passageway may be between inner and outer tubes. Nozzles may be configured to be hand guided by an operator while excavating the material. Embodiments may include air and water valves, controls, or both.

20 Claims, 8 Drawing Sheets

(56) References Cited

U.S. PATENT DOCUMENTS 2,599,980 A * 6/1952 Dunning ..... E02F 3/925 37/323
2,711,598 A * 6/1955 Craggs, Jr. ..... E02F 3/925 37/323
2,916,148 A 12/1959 Crane
3,410,412 A 11/1968 Fechter
3,498,466 A 3/1970 Fechter
3,572,839 A * 3/1971 Okabe ..... E02F 3/9206 299/17
3,630,243 A 12/1971 Hamilton
3,631,991 A 1/1972 Wacht
3,635,349 A 1/1972 Weiss
3,920,558 A 11/1975 Lind
3,930,324 A 1/1976 Wightman
4,067,369 A 1/1978 Harmon
4,213,479 A 7/1980 Pearson
4,319,784 A * 3/1982 Claringbull ..... E21B 1/02 175/135
4,362,451 A 12/1982 Thiermann
4,377,475 A 3/1983 Wiedmann
4,479,741 A * 10/1984 Berti ..... E02F 3/925 405/163
4,562,612 A * 1/1986 Williams ..... A47L 5/18 15/409
4,753,549 A 6/1988 Shock
4,761,039 A 8/1988 Hilaris
4,795,217 A * 1/1989 Hilaris ..... E21B 7/18 239/120
4,816,167 A 3/1989 Vanderlice
4,889,391 A * 12/1989 Cornelius ..... E02F 3/88 299/9
4,936,031 A * 6/1990 Briggs ..... E02F 3/925 37/189
5,016,717 A 5/1991 Simons
5,021,156 A 6/1991 Sloan
5,212,891 A 5/1993 Schuermann
5,295,317 A 3/1994 Perrott
5,299,370 A * 4/1994 Gyori ..... E02F 5/003 299/17
5,425,188 A 6/1995 Rinker
5,450,912 A 9/1995 Cahill
5,474,450 A * 12/1995 Chronister
5,487,228 A 1/1996 Marazzo
5,503,753 A 4/1996 Woodall
5,535,836 A * 7/1996 Cagianut ..... E21B 7/18 166/222
5,791,073 A 8/1998 Palmer
5,846,440 A 12/1998 Angelle
5,876,174 A 3/1999 Arsenault
5,901,478 A * 5/1999 Sawyer, Jr. ..... E02F 3/9243 37/323
6,048,200 A * 4/2000 Martin et al.
6,202,330 B1 * 3/2001 Bolton ..... B01D 50/002 175/67
6,273,512 B1 8/2001 Rajewski
6,453,584 B1 9/2002 Buckner
6,470,605 B1 10/2002 Gilman
6,484,422 B1 11/2002 Bain
6,547,964 B1 4/2003 Rajewski
6,604,304 B1 * 8/2003 Slabach ..... E02F 3/8816 37/304
6,607,666 B2 8/2003 Rajewski
6,857,837 B2 2/2005 Rajewski
8,567,299 B2 * 10/2013 Kokot, Jr. ..... F16K 31/12 89/1.13
2002/0119030 A1 8/2002 Hensler
2003/0019811 A1 1/2003 Rajewski
2004/0001747 A1 1/2004 Rajewski
2006/0086010 A1 * 4/2006 Jarnecke ..... E02F 3/8816 37/317
2008/0040945 A1 2/2008 Buckner
2009/0064544 A1 3/2009 Rajewski
2009/0183924 A1 7/2009 Tuttle
2011/0036635 A1 2/2011 Rajewski
2013/0149089 A1 6/2013 Harms, Jr.
2013/0340297 A1 12/2013 Buckner
2014/0020268 A1 1/2014 Buckner

FOREIGN PATENT DOCUMENTS

CA 2814545 4/2012
WO WO-2018137155 11/2008

* cited by examiner

NOZZLE AND VACUUM UNIT WITH AIR AND WATER

RELATED PATENT APPLICATIONS

This patent application is a continuation of, and claims priority to, patent application Ser. No. 15/247,096, filed Aug. 25, 2016, titled: Vacuum Unit and Truck with Air and Water, having the same inventors and assignee, which is a non-provisional patent application of, and claims priority to U.S. provisional patent application No. 62/209,791 filed Aug. 25, 2015, having the same inventors. The contents of these priority patent applications are incorporated herein by reference. If there are any conflicts or inconsistencies between this patent application and the priority provisional patent application, however, this patent application governs herein.

FIELD OF THE INVENTION

Various embodiments of this invention relate to vacuum units and vacuum trucks that pick up or excavate material, certain components of such units and trucks, and apparatuses that include nozzles, including air and water nozzles. Particular embodiments deliver air, water, or both, for example, that breaks up the material that is picked up by the vacuum system.

BACKGROUND OF THE INVENTION

Various vacuum units and systems have been developed and used for picking up various types of material. In specific applications, for example, vacuum units have been used for excavation, for example, where removal of the excavated material was difficult to accomplish by other methods or where the excavation had to take place where damage to equipment, such as buried equipment, was a significant risk if alternative methods of excavation were used. Further, relatively large vacuum units have been mounted on a truck, and vacuum trucks have been driven to sites where excavation has been needed or where material needed to be picked up. For example, vacuum trucks have been used to excavate around buried utilities such as pipelines buried in the ground, where shutting down the pipeline would be a significant detriment, where excavation with other means, such as a back hoe, would have a greater risk of damaging the buried utility or pipeline, impose a safety risk to workers, or a combination thereof.

Still further, water has been used to break up material (e.g., earth) at an excavation site where the material is being picked up by a vacuum unit or system. Water systems have been mounted on vacuum trucks for this purpose, and have included, among other things, a water tank, water pump, water conduit that extends to the excavation site, and a water nozzle that is hand guided at the excavation site by an operator. Vacuum trucks with water systems have been referred to as hydrovac trucks, for example. Even further, air has been used to excavate material as a replacement for excavation water. Further still, excavation systems that used water often resulted in the material becoming overly wet (e.g., mud) which has made the material poorly suited to use immediately to backfill the excavation site when the work that required the excavation was completed. On the other hand, excavation systems that used air often created excessive dust and were not as effective as water at excavating certain types of material. Needs and potential for benefit or improvement exist for vacuum units and vacuum trucks that overcome these and other deficiencies of the prior art.

Even further still, various components of vacuum trucks have been powered by an internal combustion engine mounted on the truck (e.g., that also drives the truck) but it has been difficult to transfer power from the engine to the various components that need the power. In many instances, different components had to be located on the truck where those components could get power from the engine rather than at a more convenient location, for example, relative to other components on the truck. Needs and potential for benefit or improvement exist for power transfer systems on vacuum trucks, and trucks with such power transfer systems, where the power transfer systems overcome these and other deficiencies of prior vacuum trucks and prior power transfer systems used on vacuum trucks. Needs and potential for benefit or improvement exist, for example, for power transfer systems on vacuum trucks, and trucks with such power transfer systems, where the power transfer systems power a vacuum system, a compressed air system, a boom, one or more auxiliary systems, a water system, or a combination thereof.

Moreover, vacuum trucks have been used where the engine powered the vacuum system and the speed of the engine has been varied or adjusted to control suction pressure within the vacuum system. Where the engine has been used to power other systems or components of the vacuum truck, however, changing the engine speed has changed the speed, power, or both available to these other systems or components of the vacuum truck. This has made it difficult to control the suction pressure and other systems or components (e.g., independently) to optimize all systems and components of the vacuum truck. Needs and potential for benefit or improvement exist, for example, for power transfer systems on vacuum trucks, and trucks with such power transfer systems, where the power transfer systems provides for adjustment of the vacuum system (e.g., blower speed) without changing the engine speed or that provide for changes in engine speed without changing the suction pressure.

Additionally, vacuum units have been equipped with a suction relief valve that opens to relieve the vacuum. For example, an operator of a vacuum truck has been provided control of a suction relief valve that the operator can open quickly to relieve most or all of the vacuum in the event the vacuum is having a deleterious effect. Prior art suction relief valves on vacuum units, however, have been either fully open or fully closed and were not suitable to make fine adjustments to suction pressure, for instance, to avoid a deleterious effect, for example, without disrupting excavation of the material. Needs and potential for benefit or improvement exist for suction relief valves for vacuum units and trucks and for vacuum units and vacuum trucks that overcome these and other deficiencies of the prior art, for instance, that provide the operator with more control of the suction pressure.

Furthermore, vacuum trucks have been built with the boom mounted approximately in the center of the vacuum truck relative to the left side and right side of the truck. Further, the reach of a vacuum truck has been limited by the length of the boom. Needs and potential for benefit or improvement exist for vacuum trucks that allow the truck to be used to excavate farther from the center of the truck, for example, without increasing the length of the boom, for instance, while providing appropriate structural support for the boom. Needs and potential for benefit or improvement exist for vacuum trucks that overcome these and other deficiencies of the prior art.

Further still, vacuum trucks have been manufactured with various debris tanks that hold the material once the material has been excavated. These debris tanks have been dumped in a number of ways to empty the debris tank. In some embodiments, debris tanks have been tipped to empty the material and in some embodiments debris tanks have been equipped with a sweep system or blade that moves the material (e.g., mud) within the tank. See, for example, U.S. Pat. Nos. 6,547,964, and 6,607,666 (both Rajewski) and U.S. Patent Publication 2013/10149089 (Harms JR). Such systems, however, have been, among other things, complex, expensive, high maintenance, and time consuming. Needs and potential for benefit or improvement exist for vacuum trucks and debris tanks for vacuum trucks that overcome these and other deficiencies of the prior art. Even further, needs and potential for benefit or improvement exist for vacuum bucks that have debris tanks that are capable of emptying the material without: tipping, use of an internal sweep, or use of an internal blade; that are structurally suited for the loads imposed (e.g., to support other components such as the boom, to withstand the vacuum, etc.); that utilize available space on the truck efficiently; that are relatively easy and inexpensive to manufacture; that are easy to maintain; that utilize structural components efficiently; and/or that provide for efficient and convenient transfer of the excavated material back into the excavation site when the work that required the excavation has been completed.

Room for improvement exists over the prior art in these and other areas that may be apparent to a person of skill in the art having studied this document.

SUMMARY OF PARTICULAR EMBODIMENTS OF THE INVENTION

This invention provides, among other things, vacuum units, systems, and trucks for picking up material, for example, for excavation, for instance. Further, various embodiments are or include, for example, an apparatus that includes a nozzle, for example, an air and water nozzle. Various embodiments can be used, for example, where removal of excavated material is difficult to accomplish by other methods or where the excavation must take place where damage to equipment, such as buried utilities or pipelines, is a significant risk if alternative methods of excavation are used. Certain embodiments are well suited to use in urban environments, for example, where access to the excavation site is limited.

Various embodiments (e.g., hydrovac trucks) use water and air to break up material at an excavation site where the material is being picked up by a vacuum unit or system. Further still, some embodiments allow the operator to control the amount of water and air that are being used, for example, with a nozzle that controls the flow of water and air. Even further, a number of embodiments avoid the material becoming overly wet, avoid creating excessive dust, or both, and combine various benefits of excavation with water and excavation with air. Other embodiments may include other features, acts, or limitations, for example, as described herein.

In a number of embodiments, improvements to vacuum units, vacuum trucks, and methods provide equipment that is more reliable, that lasts longer, that is more adaptable, that can be used in conditions that are more extreme, that handles abuse well, that works better, that is easier to use, that is easier to maintain, that is less expensive to manufacture, that has a lower lifecycle cost, that offers more options for use, or a combination thereof, for example, in comparison with certain alternatives.

Various specific embodiments include, for example, various apparatuses that include a nozzle, for example, an air and water nozzle. In a number of embodiments, for instance, the nozzle includes a first tube, a second tube, a first exit orifice, for example, extending to a first space inside the first tube, and (e.g., at least one) second exit orifice, for instance, extending to a second space inside the second tube. In some embodiments, for example, the first tube is concentric with the second tube, the second space is between the first tube and the second tube, or both. Further, in some embodiments, the apparatus includes a vacuum system. For instance, in certain embodiments, the vacuum system includes a tank, for example, that holds material that has been picked up by the vacuum system. Further, in particular embodiments, the vacuum system includes a blower, for instance, that draws air out of the tank, for example, to create vacuum. Still further, in some embodiments, the vacuum system includes a vacuum conduit, for example, that extends from the tank to a site where the material is picked up by the vacuum system. Even further, in various embodiments, the air and water nozzle is used to break up the material at the site where the material is picked up by the vacuum system.

In various embodiments, the apparatus includes a water system, for instance, that delivers water to the air and water nozzle. Further, various embodiments include a compressed air system, for example, that delivers compressed air to the air and water nozzle. Further still, in a number of embodiments, the air and water nozzle is configured to be hand guided by an operator. In particular embodiments, for example, the air and water nozzle is configured so that the operator (e.g., while hand guiding the air and water nozzle) can select between delivering compressed air (e.g., only) from the air and water nozzle, delivering water (e.g., only) from the air and water nozzle, and delivering both compressed air and water from the air and water nozzle, for example.

Further, some specific embodiments include an apparatus that includes a nozzle that includes a first tube and a second tube and the first tube is inside the second tube. Still further, certain (e.g., of these) embodiments include a first exit orifice, for example, extending to a first space inside the first tube, (e.g., at least one) second exit orifice, for instance, extending to a second space inside the second tube, or both. Even further, in particular embodiments, the second space is between the first tube and the second tube. Further still, in some (e.g., of these) embodiments, the apparatus further includes a vacuum system. In certain embodiments, for instance, the vacuum system includes a tank (e.g., that holds material that has been picked up by the vacuum system), a blower (e.g., that draws air out of the tank to create vacuum), and a vacuum conduit (e.g., that extends from the tank, for instance, to a site where the material is picked up by the vacuum system). In various embodiments, the nozzle is used to break up the material, for example, at the site where the material is picked up by the vacuum system. Even further still, in some embodiments, the apparatus includes a compressed air system, for example, that delivers compressed air to the nozzle, a water system, for instance, that delivers water to the nozzle, or both. Moreover, in particular embodiments, the nozzle is configured so that the operator can select (e.g., at the nozzle) between delivering compressed air (e.g., only) from the nozzle, delivering water (e.g., only) from the nozzle, delivering both compressed air and water from the nozzle, or a combination thereof, as examples.

Further, in various embodiments, the nozzle is configured to be hand guided by an operator, for example, to break up the material.

Even further specific embodiments include various vacuum units, for example, for excavating material. In some embodiments, for instance, the vacuum unit includes a vacuum system, a compressed air system, a water system, and an air and water nozzle, for example, configured to be hand guided by an operator of the vacuum unit while excavating the material. Further, in a number of embodiments, the air and water nozzle includes a body, for example, that is hand held by the operator, for instance, while excavating the material. Still further, in various embodiments, the air and water nozzle includes an air passageway through the body. In various embodiments, for example, compressed air passes through the air passageway when being used to break up the material that is picked up by the vacuum system. Further still, various embodiments include (e.g., at least one) air exit orifice, for example, from the air passageway through the body. In a number of embodiments, for instance, the compressed air passes through the at least one air exit orifice from the air passageway when the compressed air is being used to break up the material that is picked up by the vacuum system. Even further, various embodiments include a water passageway, for example, through the body. In a number of embodiments, for instance, excavation water from the water system passes through the water passageway when the excavation water is being used to break up the material that is picked up by the vacuum system. Even further still, various embodiments include at least one water exit orifice, for example, from the water passageway through the body. In a number of embodiments, for instance, the excavation water passes through the at least one water exit orifice from the water passageway when the excavation water is being used to break up the material that is picked up by the vacuum system.

Moreover, in some embodiments, the air and water nozzle further includes an air valve. In some embodiments, for example, the compressed air passes through the air valve, for instance, when the compressed air is being used to break up the material that is picked up by the vacuum system. Further, in some embodiments, the air and water nozzle includes a water valve. For instance, in some embodiments, the excavation water passes through the water valve, for example, when the excavation water is being used to break up the material that is picked up by the vacuum system. Still further, certain embodiments include an air control, for example, configured to be operated by the operator, for instance, while hand guiding the air and water nozzle and while breaking up the material that is picked up by the vacuum system. In particular embodiments, for instance, the air control opens and closes the air valve. Even further, in some embodiments, the air and water nozzle includes a water control, for example, configured to be operated by the operator, for instance, while hand guiding the air and water nozzle and while breaking up the material that is picked up by the vacuum system. In particular embodiments, for example, the water control opens and closes the water valve. Even further still, in certain embodiments, the air and water nozzle is configured so that the operator (e.g., while hand guiding the air and water nozzle at the excavation site, while breaking up the material that is picked up by the vacuum system, or both): can continuously adjust flow rate of the compressed air with the air control, can continuously adjust flow rate of the excavation water with the water control, or both. In addition, various other embodiments of the invention are also described herein, and other benefits of certain embodiments may be apparent to a person of skill in this area of technology.

BRIEF DESCRIPTION OF THE DRAWINGS

The drawings provided herewith illustrate, among other things, examples of certain aspects of particular embodiments. Other embodiments may differ. Various embodiments may include aspects shown in the drawings, described in the specification (including the claims), known in the art, or a combination thereof, as examples.

DETAILED DESCRIPTION OF EXAMPLES OF EMBODIMENTS

Figure 1:
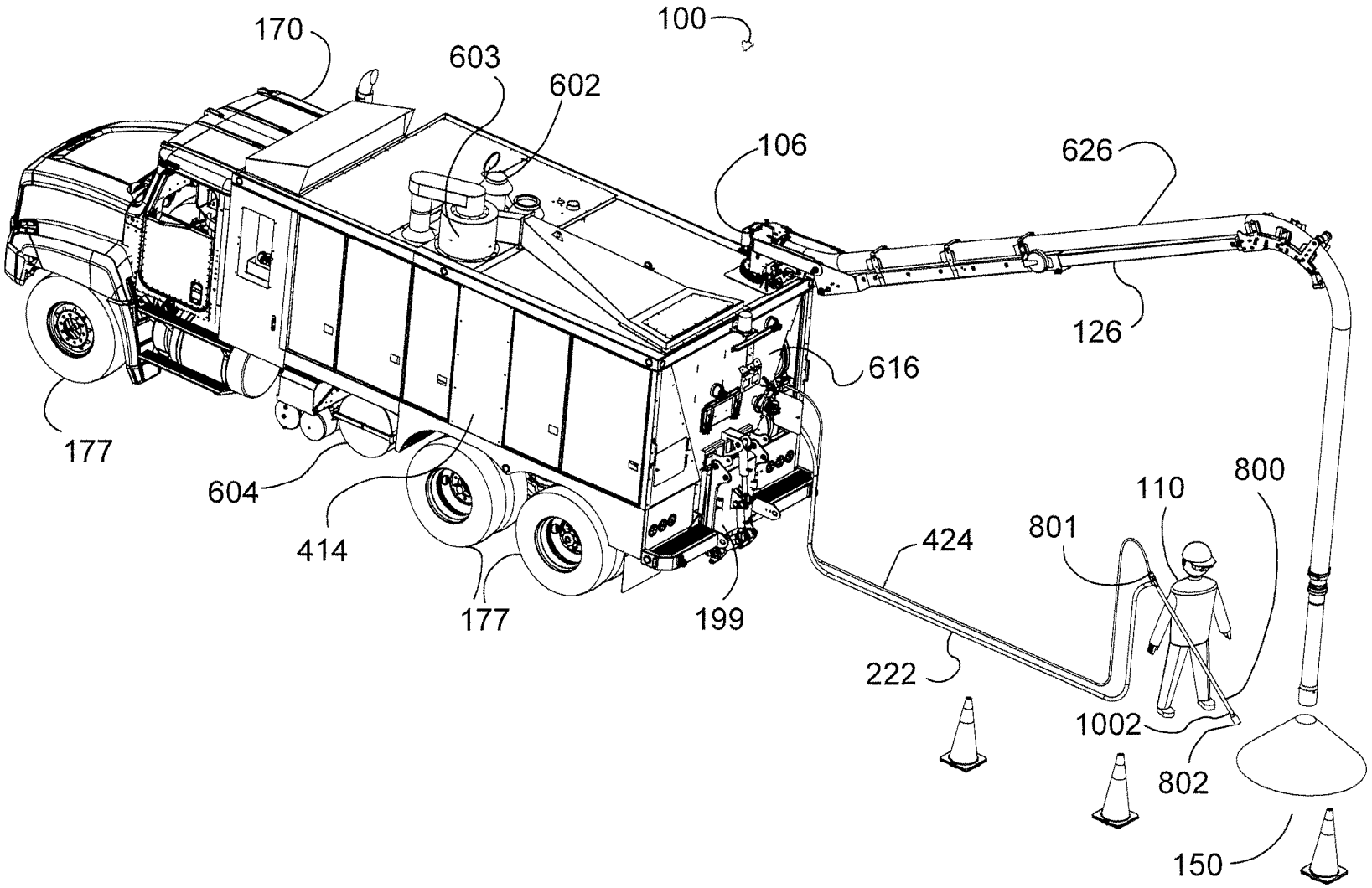
FIG. 1 is an isometric view of a vacuum unit for excavating material that includes a truck, wherein the vacuum unit and truck are shown at an angle that illustrates, among other things, the top, rear, and left side of the truck.

This patent application describes, among other things, examples of certain embodiments, and certain aspects thereof. Other embodiments may differ from the particular examples described in detail herein. Various embodiments are or concern vacuum units, vacuum trucks, components and systems thereof (e.g., including apparatuses that include nozzles, including air and water nozzles), excavation systems, and methods associated therewith. Certain embodiments of a vacuum unit or vacuum truck for excavating material include, for example, a vacuum system, a compressed air system, a water system, an air and water nozzle (e.g., lance), or a combination thereof. Vacuum unit 100 shown in FIG. 1, for example, is a vacuum truck for excavating material, and includes, in the embodiment illustrated, a vacuum system 600 shown in FIGS. 6 and 7, compressed air system 200 shown in FIGS. 2 and 3, water system 400 shown in FIGS. 4 and 5, an air and water nozzle 800 (e.g., lance) shown in FIGS. 8 to 11. In the embodiment illustrated, for instance, vacuum system 600 picks up the material.

Various embodiments include, for example, vacuum units, for instance, for excavating material. In a number of embodiments, for example, a vacuum unit includes a vacuum system, a compressed air system, a water system, and an air and water nozzle. In a number of embodiments, for instance, the air and water nozzle is configured to be hand guided at the excavation site by an operator of the vacuum unit while excavating the material. Further, in various embodiments, the vacuum system picks up the material. In various embodiments, for example, the air and water nozzle is configured so that the operator, while hand guiding the air and water nozzle at the excavation site and while breaking up the material that is picked up by the vacuum system, can select between breaking up the material with the compressed air only, breaking up the material with the excavation water only, and breaking up the material with both compressed air and excavation water.

In various embodiments, the air and water nozzle includes a body, for example, that is hand held at the excavation site by the operator while excavating the material. Further, a number of embodiments include an air passageway through the body, a water passageway through the body, an air valve, a water valve, an air control, a water control, or a combination (e.g., all) thereof. Still further, in a number of embodiments, the compressed air passes through the air passageway when the compressed air is being used to break up the material that is picked up by the vacuum system, the excavation water passes through the water passageway when the excavation water is being used to break up the material that is picked up by the vacuum system, or both.

In a number of embodiments, for instance, the compressed air passes through the air valve when the compressed air is being used to break up the material that is picked up by the vacuum system. Further, in various embodiments, the air valve is used to throttle the compressed air that is being used to break up the material. Further still, in a number of embodiments, the excavation water passes through the water valve when the excavation water is being used to break up the material that is picked up by the vacuum system. Even further, in various embodiments, the water valve is used to throttle the excavation water that is being used to break up the material. Even further still, in a number of embodiments, the air control is configured to be operated by the operator while hand guiding the air and water nozzle and while breaking up the material that is picked up by the vacuum system. In various embodiments, for example, the air control opens and closes the air valve used to throttle the compressed air that is being used to break up the material. Moreover, in various embodiments, the water control is configured to be operated by the operator while hand guiding the air and water nozzle and while breaking up the material that is picked up by the vacuum system. In a number of embodiments, for example, the water control opens and closes the water valve used to throttle the excavation water that is being used to break up the material.

Still further, in a number of embodiments, the vacuum system includes a debris tank that holds the material once excavated, a blower that draws air out of the debris tank to create vacuum, a vacuum conduit that extends from the debris tank to an excavation site where the material is excavated, or a combination (e.g., all) thereof, as examples. Even further, in various embodiments, the compressed air system breaks up the material that is picked up by the vacuum system. Further still, in a number of embodiments, the compressed air system includes an air compressor that compresses air, a compressed air conduit that extends from the air compressor to the excavation site, or both, as examples. Even further still, in various embodiments, the water system breaks up the material that is picked up by the vacuum system. Moreover, in a number of embodiments, the water system includes a water tank that stores excavation water used in the water system, a water pump that pumps the excavation water from the water tank, a water conduit that extends from the water pump to the excavation site, or a combination (e.g., all) thereof, as examples.

In particular embodiments, the air and water nozzle is configured so that the operator, for example, while hand guiding the air and water nozzle at the excavation site and while breaking up the material that is picked up by the vacuum system, can continuously adjust the flow rate of the compressed air with the air control, can continuously adjust flow rate of the excavation water with the water control, or both. Further, in certain embodiments, the compressed air system includes at least one of an air receiver that stores compressed air or an air compressor that compresses air. Still further, in a number of such embodiments, the compressed air system further includes a compressed air conduit that extends from the air receiver or the compressor to the excavation site. Even further, in particular embodiments, the water system includes a water tank that stores excavation water used in the water system and a water conduit that extends from the water pump to the excavation site.

In various embodiments, the vacuum unit includes a truck, for example, that includes an engine, a transmission, multiple wheels, or a combination thereof. In a number of embodiments, the vacuum system, the compressed air system, and the water system are mounted on the truck, for instance. Further, in a number of embodiments, the operator can control flow of compressed air and can control flow of excavation water without adding parts to the air and water nozzle, without removing parts from the air and water nozzle, or both.

In some embodiments, the body of the air and water nozzle has an overall body length that is at least five times greater than any overall dimension of the body that is perpendicular to the overall body length, the air passageway is parallel to the overall body length, the water passageway is parallel to the overall body length, or a combination (e.g., all) thereof. Further, in some embodiments, the air and water nozzle has an overall nozzle length that is at least three times greater than any overall dimension of the air and water nozzle that is perpendicular to the overall nozzle length, the air passageway is parallel to the overall nozzle length, the water passageway is parallel to the overall nozzle length, or a combination (e.g., all) thereof. Still further, in some embodiments, the body of the air and water nozzle includes a water tube, an air tube, or both. Even further, in particular embodiments, the water tube is parallel to the air tube, the water tube is concentric with the air tube, or both.

In a number of embodiments, the air and water nozzle has a first end where the air conduit and the water conduit attach to the air and water nozzle, the air and water nozzle has a second end where the compressed air and the excavation water exit the air and water nozzle when breaking up the material with both compressed air and excavation water, the second end is opposite the first end or a combination (e.g., all) thereof. Further, in particular embodiments, the air valve is located at the first end of the air and water nozzle, the water valve is located at the first end of the air and water nozzle, or both. Still further, in certain embodiments, the air control is located at the first end of the air and water nozzle, the water control is located at the first end of the air and water nozzle, or both. Even further, in a number of embodiments, the air and water nozzle includes at least one air exit orifice located at the second end of the air and water nozzle, the air and water nozzle includes at least one water exit orifice located at the second end of the air and water nozzle, or both. Even further still, in particular embodiments, the air control is a handle connected to the air valve, the water control is a handle connected to the water valve, or both.

In certain embodiments, the body of the air and water nozzle includes an inner tube and an outer tube, for example, concentric with the inner tube. Further, in some embodiments, the air and water nozzle includes a first exit orifice extending to the inner tube, at least one second exit orifice extending to an interstitial space between the inner tube and the outer tube, or both. Still further, in particular embodiments, for example, the at least one second exit orifice includes two second exit orifices extending, for example, to the interstitial space between the inner tube and the outer tube. Even further, in certain embodiments, the two second exit orifices and the first exit orifice are arranged in a line, for example, with the first exit orifice in between the two second exit orifices.

In the embodiment shown (e.g., in FIGS. 6 and 7), vacuum system 600 includes debris tank 616 that holds the material once excavated, blower 606 that draws air out of debris tank 616 to create the vacuum, and vacuum conduit 626 that extends from debris tank 616 to excavation site 150 where the material is excavated. In the embodiment shown, vacuum conduit 626 is part of, and is supported overhead by, boom 126. Further, in the embodiment illustrated, boom 126 includes rotating mount 106 shown in FIGS. 1, 6, and 7. Still further, in the embodiment shown (e.g., in FIGS. 6 and 7), vacuum system 600 also includes, among other things, blower exhaust 602, cyclone filter or cyclone filtration system 603, and filter or filter housing 604. Other embodiments may differ.

In various embodiments, the compressed air system (e.g., 200) breaks up the material (i.e., supplies compressed air that breaks up the material) that is picked up by the vacuum system (e.g., 600). In the embodiment illustrated (e.g., in FIGS. 2 and 3), compressed air system 200 includes air compressor 202 that compresses air and compressed air conduit 222 that extends from air compressor 202 to excavation site 150. In the embodiment illustrated, air conduit 222 is partially rigid tubing or pipe and partially hose. Other embodiments may differ. Further, in some embodiments, the compressed air conduit is attached to and runs beside the vacuum conduit (e.g., in the boom), but in the embodiment illustrated, compressed air conduit 222 is separate from vacuum conduit 626 and compressed air conduit 222 is placed (e.g., at least part of the hose section) on the ground (e.g., as shown). In the embodiment illustrated (e.g., in FIG. 2), compressed air system 200 further includes, among other things, the air hose reel show, heat exchanger 204, intake filter 205, and compressor oil filter 203.

Figure 2:
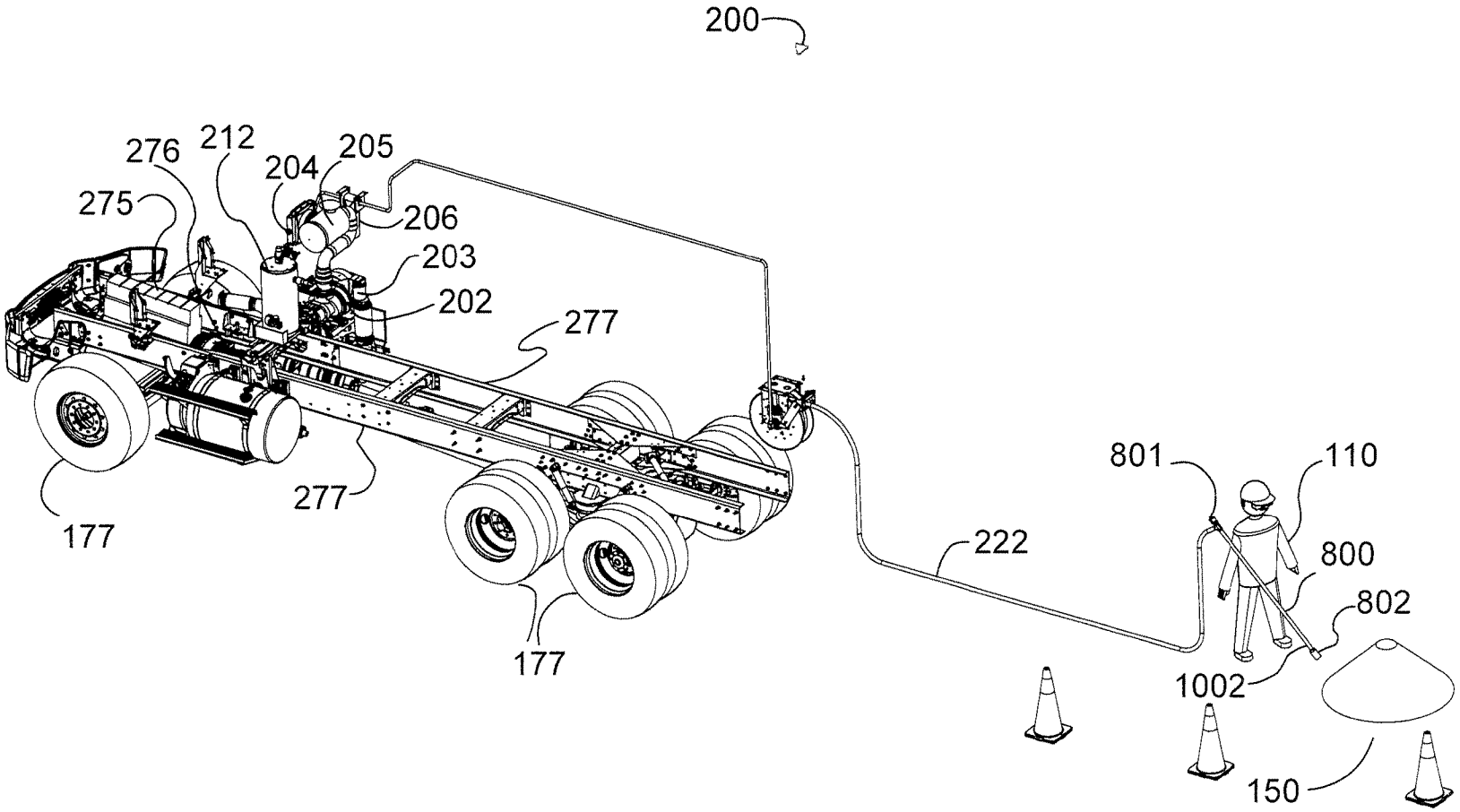
FIG. 2 is an isometric view of the vacuum unit and truck of FIG. 1 with many of the components omitted to better illustrate the drivetrain and the compressed air system, among other things, shown at the same angle as FIG. 1.
Figure 3:
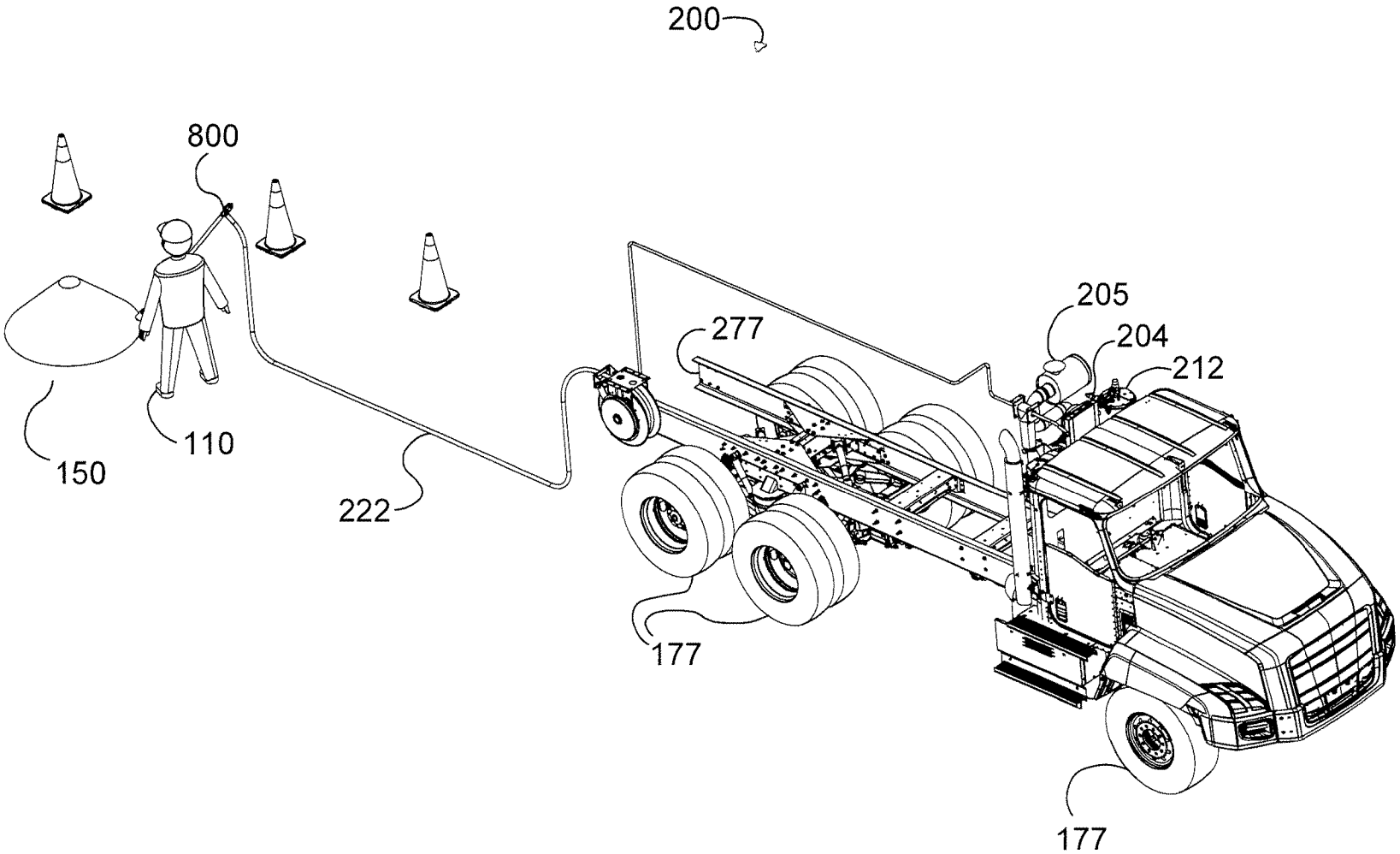
FIG. 3 is another isometric view of the vacuum unit and truck of FIG. 1 with many of the components omitted to better illustrate the compressed air system, taken from a different angle than FIG. 1 or 2 and showing the top, front, and right side of the truck.

Some embodiments further include an air receiver (e.g., 212 shown in FIG. 2), for example, connected to the discharge of the air compressor (e.g., 202) or connected to the compressed air conduit (e.g., 222). In some embodiments, compressed air can be provided (e.g., from the compressor, for instance, 202 or air receiver, for instance, 212) for other purposes besides excavation, such as for driving pneumatic tools (e.g., external to vacuum unit 100 or truck) or for operating other systems on the truck (e.g., 170). Moreover, in some embodiments, the compressed air conduit (e.g., 222) serves (e.g., among other things) as an air receiver, and in some embodiments, no separate air receiver is included. In some embodiments, the air compressor (e.g., 202) is an "on demand" system, for example, and the compressor may be off, in various embodiments, until there is a need for air pressure and then may operate until the demand is gone. Further, in certain embodiments, an oil water separator may be included, for instance, located where reference number 212 is shown in FIG. 2. In a number of embodiments, an oil water separator is not necessarily referred to as an air receiver but may store some amount of pressurized air and may act, at least to some degree, as an air receiver (e.g., in combination with air conduit 222.

Figure 4:
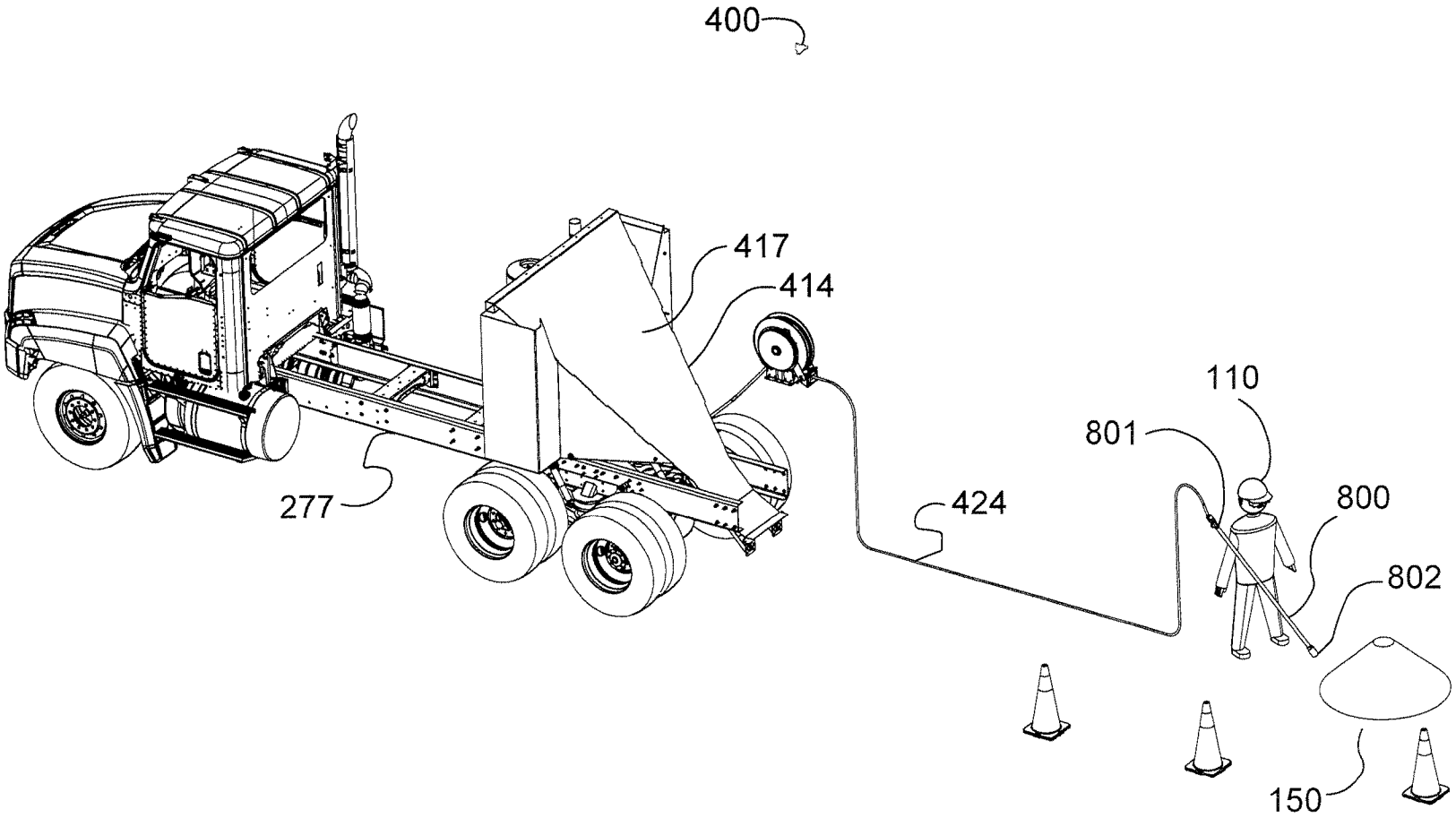
FIG. 4 is an isometric view of the vacuum unit and truck of FIG. 1 with many of the components omitted to better illustrate, among other things, the water system, shown at the same angle as FIGS. 1 and 2.
Figure 5:
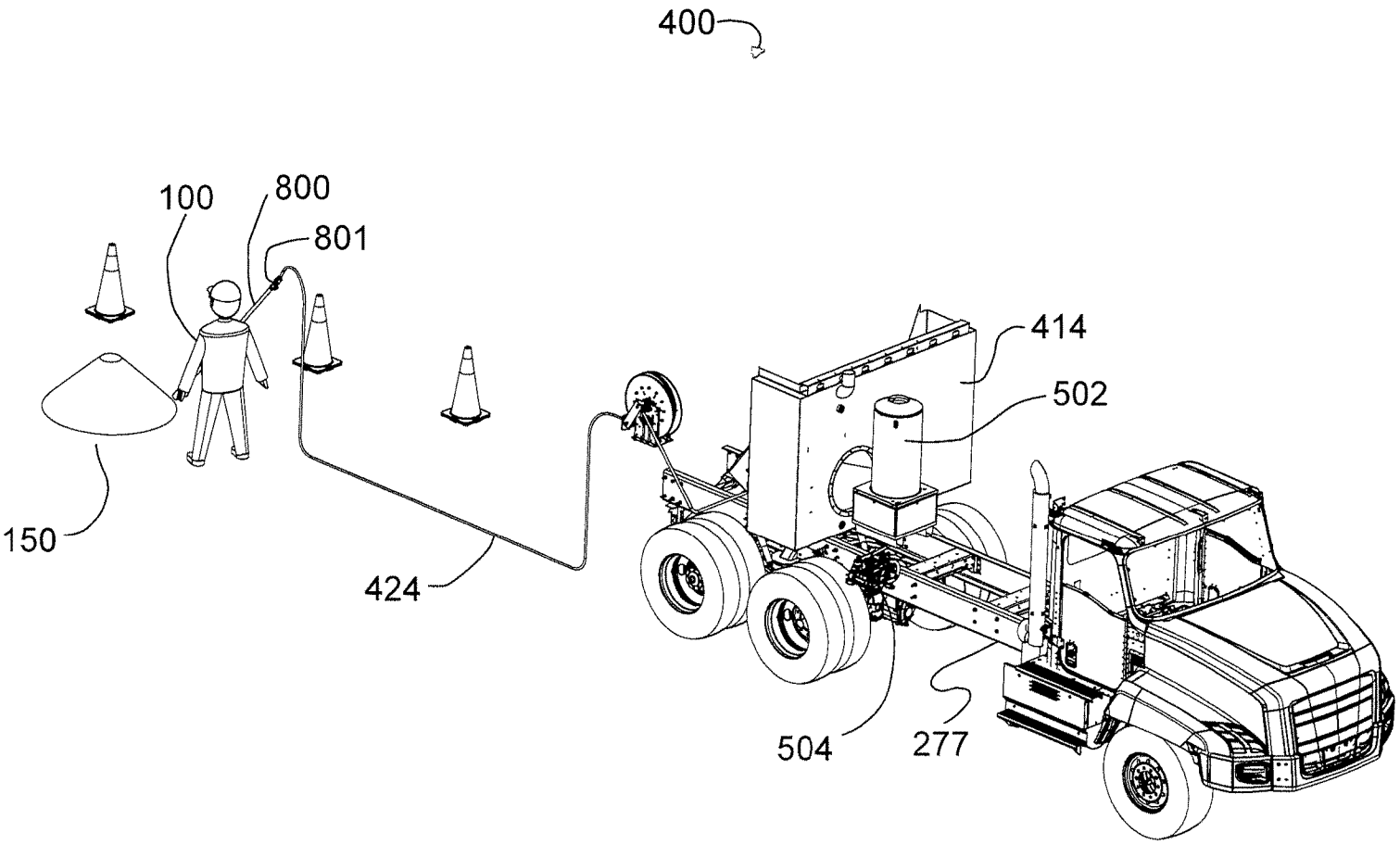
FIG. 5 is another isometric view of the vacuum unit and truck of FIG. 1 with many of the components omitted to better illustrate the water system, shown at the same angle as FIG. 3 and showing the top, front, and right side of the truck.
Figure 6:
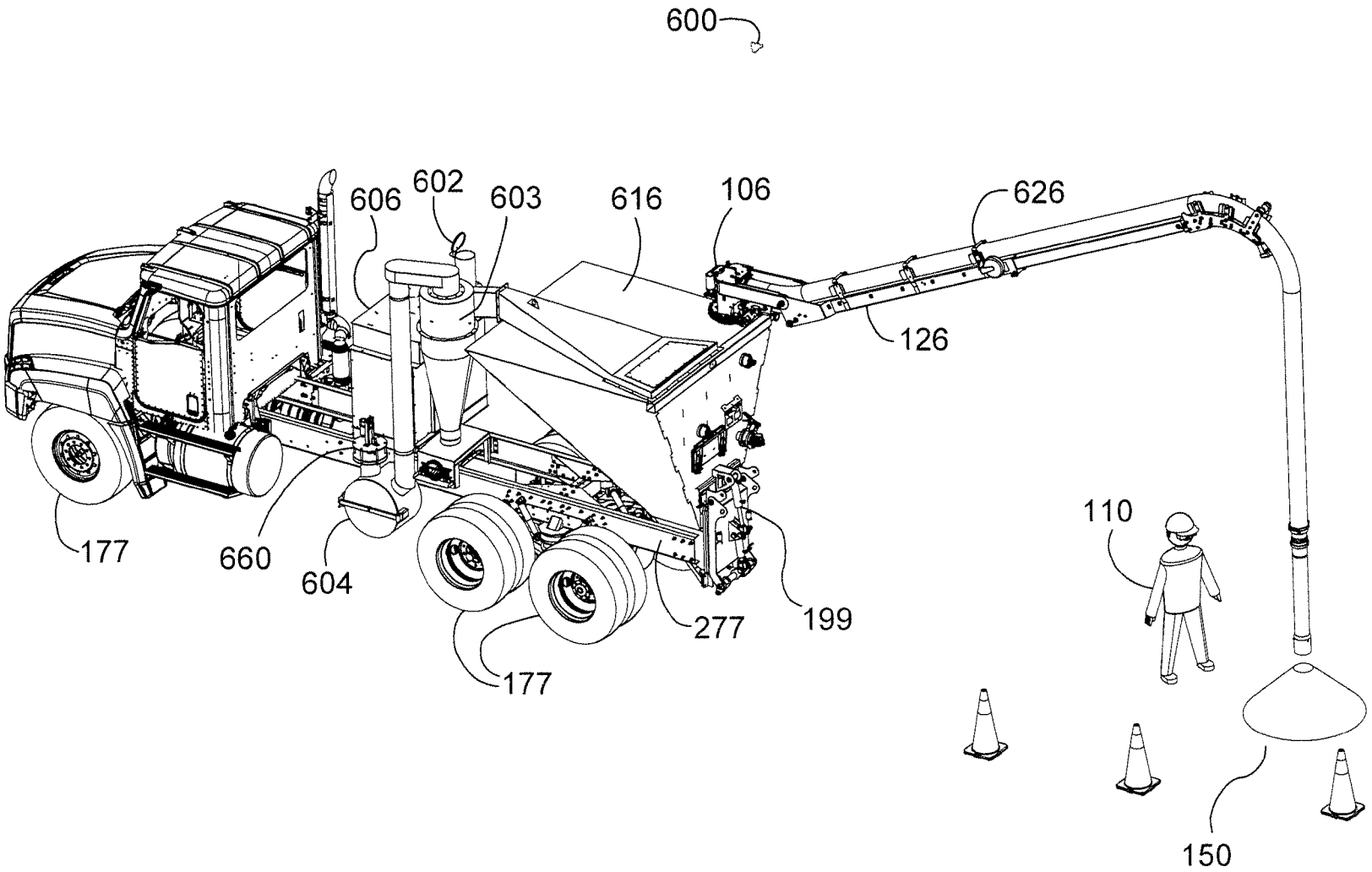
FIG. 6 is an isometric view of the vacuum unit and truck of FIG. 1 with many of the components omitted to better illustrate the vacuum system, shown at the same angle as FIGS. 1, 2, and 4.
Figure 7:
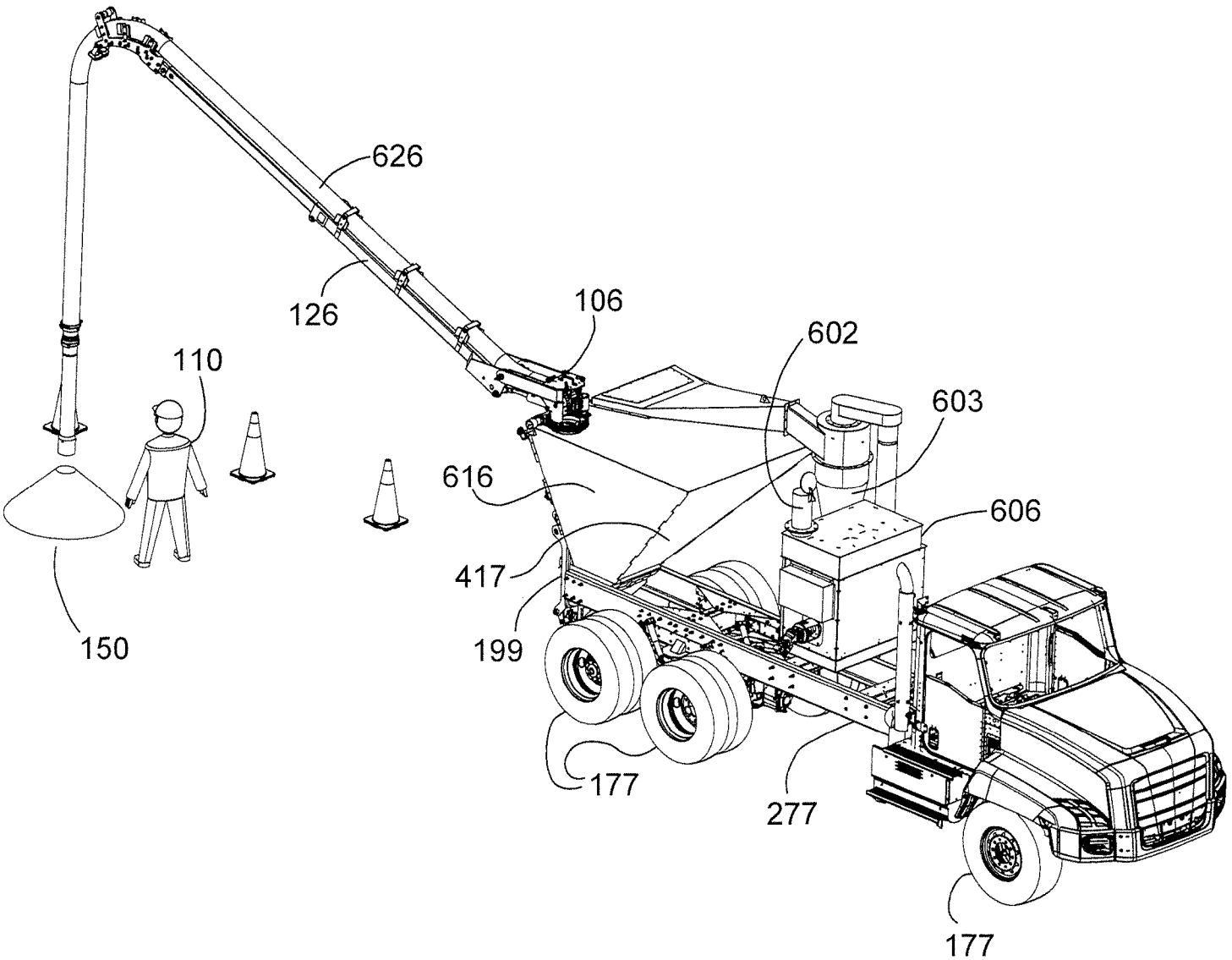
FIG. 7 is another isometric view of the vacuum unit and truck of FIG. 1 with many of the components omitted to better illustrate the vacuum system, shown at the same angle as FIGS. 3 and 5 and showing the top, front, and right side of the truck.

Further, in various embodiments, the water system (e.g., 400 shown in FIGS. 4 and 5) breaks up the material (i.e., supplies pressurized excavation water that breaks up the material) that is picked up by the vacuum system (e.g., 600 shown in FIGS. 6 and 7). In the embodiment shown, water system 400 includes water tank 414 that stores (e.g., excavation) water used in water system 400, water pump 504 (e.g., 3000 psi) shown in FIG. 5 that pumps the water from water tank 414, and water conduit 424 that extends from water pump 504 to the excavation site (e.g., 150). In the embodiment illustrated, water conduit 424 is partially hose and includes the water hose reel shown. In different embodiments, the remainder of water conduit 424 can be hose, rigid tubing or pipe, or a combination thereof, as examples. Further, in some embodiments, the water conduit is attached to and runs beside the vacuum conduit, but in the embodiment illustrated, water conduit 424 is separate from vacuum conduit 626 and is placed (e.g., at least part of the hose section) on the ground (e.g., as shown in FIGS. 1, 4, and 5), for example, with, similar to, or parallel to, compressed air conduit 222 (e.g., shown together in FIG. 1). In some embodiments, a boiler (e.g., 502 shown in FIG. 5) is provided that, in different embodiments, can provide hot water, steam, or both. In some embodiments, for example, hot water, steam, or a combination thereof, can be provided to the combo lance or air and water nozzle (e.g., 800) to cut through frozen soil. In some embodiments with a boiler (e.g., 502), however, the boiler only produces hot water and does not produce steam. In different embodiments, steam can be provided in addition to, or instead of, water, or, as an operator-selectable alternative to water, as examples.

In various embodiments, the lance, digging tip, or air and water nozzle (e.g., 800 shown in FIGS. 1 to 5 and 8 to 11) is configured to be hand guided at the excavation site (e.g., 150) by an operator (e.g., 110 shown in FIGS. 1 to 7) of the vacuum unit (e.g., 100) while excavating the material. In the embodiment depicted, air and water nozzle 800 (shown, for example, in FIG. 8) includes body 808 that is hand held at the excavation site by operator 110 while excavating the material. In the embodiment illustrated, air and water nozzle 800 and body 808 include air passageway 902 (shown in FIGS. 9 and 10) through body 808, and water passageway 903 through body 808. In a number of embodiments, the compressed air (e.g., from system 200) passes through the air passageway (e.g., 902) when the compressed air is being used to break up the material that is picked up by the vacuum system (e.g., 600) and the excavation water (e.g., from system 400) passes through the water passageway (e.g., 903) when the excavation water is being used to break up the material that is picked up by the vacuum system (e.g., 600, for example, at excavation site 150).

Moreover, in a number of embodiments, the vacuum unit or the air and water nozzle includes an air valve, a water valve, an air control, a water control, or a combination (e.g., all four) thereof. In the embodiment illustrated (e.g., in FIGS. 8 to 11), for example, vacuum unit 100, and specifically, air and water nozzle 800, includes air valve 820, water valve 830, air control 825, and water control 835 (e.g., shown in FIGS. 8 and 9). In various embodiments, the compressed air passes through the air valve (e.g., 820) when the compressed air (e.g., from compressed air system 200) is being used, for instance, to break up the material (e.g., at excavation site 150) that is picked up by the vacuum system (e.g., 600). Further, in certain embodiments, the air valve (e.g., 820) is used to throttle the compressed air that is being used to break up the material. Still further, in some embodiments, the excavation water (e.g., from water system 400) passes through the water valve (e.g., 830) when the excavation water is being used to break up the material that is picked up by the vacuum system (e.g., 600). Even further, in particular embodiments, the water valve (e.g., 830) is used to throttle the excavation water that is being used to break up the material (e.g., at excavation site 150).

Further still, in some embodiments, the air control (e.g., 825) is configured (e.g., including being appropriately positioned within reach) to be operated by the operator (e.g., 110), for example, while hand guiding the air and water nozzle (e.g., 800) and while breaking up the material (e.g., at excavation site 150) that is picked up by the vacuum system (e.g., 600). Even further still, in the embodiment shown, air control 835 opens and closes (i.e., when moved by operator 110) air valve 820 used to throttle the compressed air that is being used to break up the material. Moreover, in the embodiment shown, water control 835 is configured to be operated by operator 110 while hand guiding air and water nozzle 800 and while breaking up the material at excavation site 150 that is picked up by vacuum system 600.

Furthermore, in the embodiment shown, water control 835 opens and closes water valve 830 used to throttle the excavation water that is being used to break up the material (i.e., when moved by operator 110).

Moreover, in various embodiments, the air control, the water control, or both, are mechanical, and can include, in different embodiments, a handle, shaft, knob, or linkage connected to the air valve or water valve. For instance, in some embodiments, the air control is a handle connected to the air valve, the water control is a handle connected to the water valve, or both. In the embodiment shown, for example, air control 825 is a first handle connected to air valve 820, and water control 835 is a second handle connected to water valve 830. In other embodiments, however, the air control, the water control, or both, are electrical, as another example, and can include a switch, button, or keypad, that is electrically connected to an electrical actuator or solenoid at the air valve, water valve, or both, as other examples. Still further, in certain embodiments, the air and water nozzle (e.g., 800) is configured so that the operator, (e.g., 110, for instance, while hand guiding air and water nozzle 800 at excavation site 150 and while breaking up the material that is picked up by vacuum system 600), can select (e.g., by moving one or both of controls 825 and 835) between (1) breaking up the material with the compressed air (e.g., from compressed air system 200) only, (2) breaking up the material with the excavation water (e.g., from water system 400) only, or (3) breaking up the material with both compressed air and excavation water. In other words, in certain embodiments, the air and water nozzle (e.g., 800) is configured so that the operator, (e.g., 110, for example, while hand guiding the air and water nozzle at the excavation site, for example, 150, and while breaking up the material that is picked up by the vacuum system, for instance, 600), can deliver air (e.g., compressed air from system 200), water (e.g., pressurized excavation water from system 400), or both, (e.g., to break up the material that is being excavated, for instance, at site 150).

In some embodiments, the air and water nozzle (e.g., 800) is configured so that the operator, (e.g., 110, for instance, while hand guiding the air and water nozzle at the excavation site and while breaking up the material that is picked up by the vacuum system), can continuously adjust flow rate of the compressed air with the air control (e.g., 825), can continuously adjust flow rate of the excavation water with the water control (e.g., 835), or both. As used herein, an operator (e.g., 110) being able to "continuously adjust" a flow rate means that the operator can adjust the flow rate to be essentially any flow rate within a range of flow rates. In contrast, in other embodiments, the air and water nozzle is configured so that the operator, for example, while hand guiding the air and water nozzle at the excavation site and while breaking up the material that is picked up by the vacuum system, can adjust flow rate of the compressed air with the air control (e.g., only) at multiple different discrete airflow rates and can adjust flow rate of the excavation water with the water control at (e.g., only) multiple different discrete water flow rates. In various embodiments, for example, there may be 2, 3, 4, 5, 6, 7, 8, 9, 10, 12, 15, or another number of different discrete flow rates that the operator may be able to choose from, for instance, over a range of flow rates. In some embodiments, these different discrete flow rates may include no flow. In a number of embodiments, the actual flow rate (e.g., of each discrete flow rate, of each non-zero flow rate, or at the limits of the range of flow rates) may depend, for example, on air or water pressure. Even further still, in various embodiments, the operator (e.g., 110) can control flow of compressed air and can control flow of excavation water, for example, for excavation, without adding or removing parts to or from the air and water nozzle (e.g., 800, for instance, without changing an exit orifice).

Figure 8:
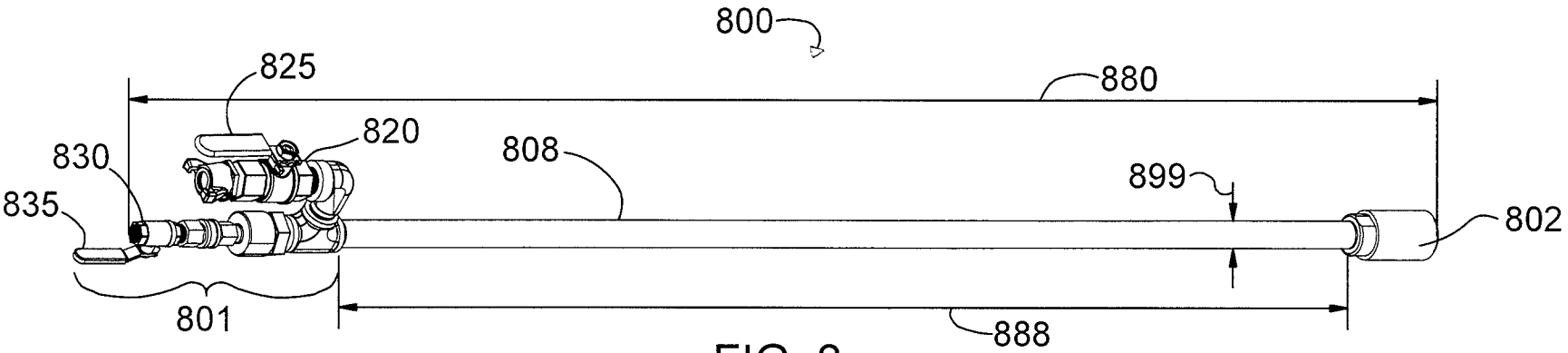
FIG. 8 is an isometric view of the air and water nozzle of the vacuum unit and truck of FIGS. 1 to 7.

In a number of embodiments, the air and water nozzle is elongated or slender. FIG. 8 illustrates an example. In the embodiment shown, for example, body 808 of air and water nozzle 800 has an overall body length 888 that is at least five times greater than any overall dimension of body 808 that is perpendicular to overall body length 888. In the embodiment shown, for instance, diameter 899 is an example of an overall dimension of body 808 that is perpendicular to overall body length 888. Moreover, in various embodiments, the body of the air and water nozzle has an overall body length that is greater than any overall dimension of the body that is perpendicular to the overall body length by a factor of at least 2, 3, 4, 6, 7, 8, 9, or 10, as other examples. Further, in some embodiments, the air passageway is parallel to the overall body length, the water passageway is parallel to the overall body length, or both. In the embodiment shown, for example, air passageway 902 is parallel to overall body length 888 and water passageway 903 is parallel to overall body length 888. As used herein, unless stated otherwise, "parallel" means parallel to within 10 degrees.

Further still, in some embodiments, the air and water nozzle has an overall nozzle length (i.e., length of the air and water nozzle) that is at least three times greater than any overall dimension of the air and water nozzle that is perpendicular to the overall nozzle length. In the embodiment depicted, for example, air and water nozzle 800 has an overall nozzle length 880 that is at least three times greater than any overall dimension of air and water nozzle 800 that is perpendicular to overall nozzle length 880. In the embodiment shown, for instance, dimension 999 is an example of an overall dimension of air and water nozzle 800 that is perpendicular to overall nozzle length 880. In various embodiments, the air and water nozzle has an overall nozzle length that is greater than any overall dimension of the air and water nozzle that is perpendicular to the overall nozzle length by a factor of at least 1.5, 2, 2.5, 3.5, 4, 5, 6, 7, 8, 9, or 10, as other examples. Still further, in some embodiments, the air passageway is parallel to the overall nozzle length, the water passageway is parallel to the overall nozzle length, or both. In the embodiment shown, for example, air passageway 902 is parallel to overall nozzle length 880 and water passageway 903 is parallel to the overall nozzle length 880.

Figure 9:
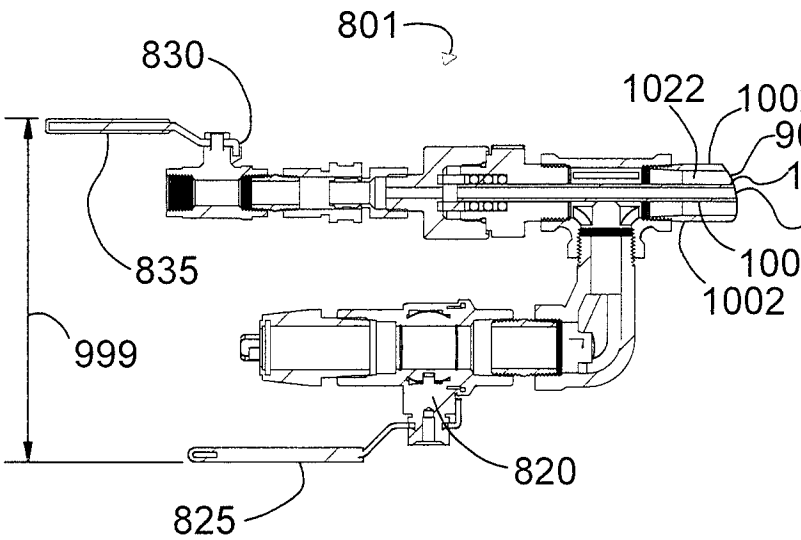
FIG. 9 is a cross sectional side view of a first end of the air and water nozzle of FIG. 8 where the air conduit and the water conduit attach to the air and water nozzle.
Figure 10:
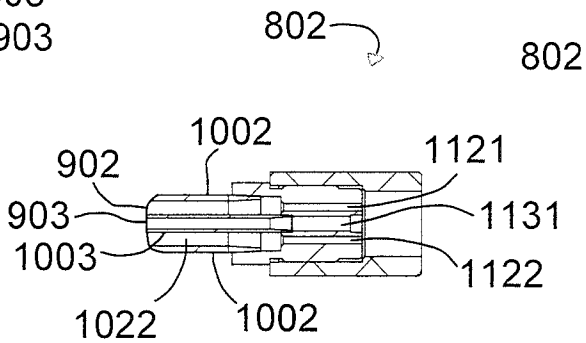
FIG. 10 is a cross sectional side view of a second end of the air and water nozzle of FIG. 8 where the compressed air and the excavation water exit the air and water nozzle when breaking up the material that is being excavated.
Figure 11:
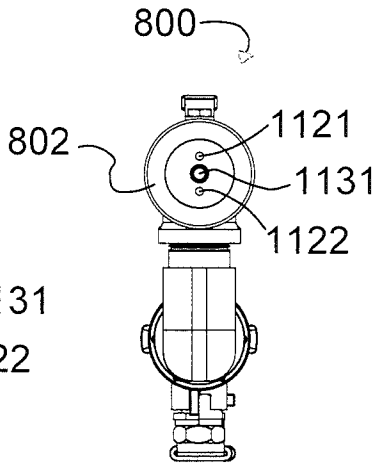
FIG. 11 is an end view of the second end of the air and water nozzle of FIGS. 8 and 10 where the compressed air and the excavation water exit the air and water nozzle when breaking up the material that is being excavated.

In a number of embodiments, the air and water nozzle has a first end where the air conduit and the water conduit connect or attach to the air and water nozzle, the air and water nozzle has a second end where the compressed air and the excavation water exit the air and water nozzle (e.g., when breaking up the material with compressed air, excavation water, or both), and the second end is opposite the first end. In the embodiment shown, for example, air and water nozzle 800 has first end 801 where air conduit 222 and water conduit 424 connect or attach (e.g., as shown in FIG. 1, for instance, hose connections) to air and water nozzle 800, and air and water nozzle 800 has second end 802 where the compressed air and the excavation water exit air and water nozzle 800 (e.g., when breaking up the material at excavation site 150 with compressed air, excavation water, or both). Further, in the embodiment illustrated, second end 802 is opposite (i.e., on air and water nozzle 800) first end 801. FIGS. 9 to 11 illustrate second end 802 and first end 801 in more detail.

Further, in some embodiments, the air valve is located at the first end of the air and water nozzle, the water valve is located at the first end of the air and water nozzle, or both. Still further, in some embodiments, the air control is located at the first end of the air and water nozzle, the water control is located at the first end of the air and water nozzle, or both. In the embodiment shown, for example, air valve 820 is located at first end 801 of air and water nozzle 800, water valve 830 is located at first end 801 of air and water nozzle 800, air control 825 is located at first end 801 of air and water nozzle 800, and water control 835 is located at first end 801 of air and water nozzle 800. Still further, in some embodiments, the air and water nozzle includes at least one air exit orifice located at the second end of the air and water nozzle, the air and water nozzle includes at least one water exit orifice located at the second end of the air and water nozzle, or both. In the embodiment shown, for example, (e.g., in FIGS. 10 and 11) air and water nozzle 800 includes air exit orifices 1121 and 1122 located at second end 802 of air and water nozzle 800, and air and water nozzle 800 includes water exit orifice 1131 located at the second end 802 of air and water nozzle 800.

In some embodiments, the air and water nozzle or the body of the air and water nozzle includes a water tube, an air tube, or both. Further, in a number of embodiments, the water tube is parallel to the air tube, the water tube is concentric with the air tube, or both. Even further, in various embodiments, the body of the air and water nozzle includes an inner tube and an outer tube, for example, that are concentric. In the embodiment shown, for example, air and water nozzle 800, and specifically, body 880 of air and water nozzle 800, includes water tube 1003 and air tube 1002. See, for example, FIGS. 9 and 10. Further, in the embodiment shown, water tube 1003 is parallel to air tube 1002, and water tube 1003 is concentric with and inside of air tube 1002. In the embodiment shown, body 808, air tube 1002, and water tube 1003 each have a circular cross section. Other embodiments, however, may differ. Even further, in the embodiment illustrated, body 808 of air and water nozzle 800 includes an inner tube (i.e., water tube 1003) and an outer tube (i.e., air tube 1002) that, in this embodiment, are concentric. In some embodiments, for example, the water tube, air tube, or both, may be made of tubing or pipe, for example, metal (e.g., steel, stainless steel, copper, aluminum, or brass) or plastic.

In a number of embodiments, the air and water nozzle includes a first exit orifice, at least one second exit orifice, or both. For example, in some embodiments, the air and water nozzle includes a first exit orifice extending to the inner tube, at least one second exit orifice extending to an interstitial space between the inner tube and the outer tube, or both. Further, in some embodiments, the at least one second exit orifice includes two second exit orifices, for instance, extending to the interstitial space between the inner tube and the outer tube. Further still, in some embodiments, the (e.g., two) second exit orifices and the first exit orifice are arranged in a line, for example, with the first exit orifice in between the two second exit orifices. An example is illustrated. In the embodiment shown, air and water nozzle 800 includes first exit orifice 1131, and two second exit orifices 1121 and 1122. Even further, in the embodiment illustrated, air and water nozzle 800 includes first exit orifice 1131 extending to inner water tube 1003 and second exit orifices 1121 and 1122 extending to the interstitial space 1022 between inner water tube 1003 and outer air tube 1002. Even further still, in the embodiment shown, the two second exit orifices 1121 and 1122, extending to interstitial space 1022, and first exit orifice 1131, are arranged in a line, as shown in FIG. 11, with first exit orifice 1131 in between the two second exit orifices 1121 and 1122. Various embodiments include different numbers of second exit orifices, extending to the interstitial space, for instance, surrounding one first exit orifice. Different embodiments include, for example, 2 (i.e., as shown), 3, 4, 5, 6, 7, 8, 9, 10, or 12 second exit orifices, for example, extending to the interstitial space, for instance, surrounding one first exit orifice.

In a number of embodiments, a vacuum truck includes, for instance, among other things, an engine, a transmission, multiple wheels, and a vacuum unit, for example, as described in various embodiments herein. Further, in some embodiments, a vacuum unit (e.g., 100) includes a truck, for example, that includes, among other things, an engine, a transmission, multiple wheels. In the embodiment shown, for example, vacuum unit 100 includes truck 170 (shown fully assembled in FIG. 1), that includes, among other things, engine 275 and transmission 276 (shown in FIG. 2), and multiple wheels 177 and frame 277 (shown in FIGS. 2 to 7). In various embodiments, a vacuum truck (e.g., 170) includes multiple hydraulic systems (e.g., 3), for example, that transfer power to different systems or components on the truck. Still further, in some embodiments, a vacuum truck, for example, for excavating material, includes, among other things, multiple wheels (e.g., 177) that support the vacuum truck, an internal combustion engine (e.g., a Diesel engine, for instance, 275 shown in FIG. 2) that provides power to turn at least a subset (e.g., at least two) of the multiple wheels (e.g., 177) to move the vacuum truck (e.g., 170), a vacuum system (e.g., 600) that picks up the material, a boom (e.g., 126), for example, that includes a vacuum conduit (e.g., 626) that extends to an excavation site (e.g., 150) where the material is excavated, a compressed air system (e.g., 200), and multiple hydraulic systems. Some embodiments include, for instance, a first hydraulic system, for example, that drives the vacuum system (e.g., 600) that picks up the material, a second hydraulic system, for example, that drives the compressed air system (e.g., 200), and a third hydraulic system, for example, that drives the boom (e.g., 126). Embodiments are also contemplated, however, that include 1, 2, 4, 5, 6, or 7 hydraulic systems as other examples.

In various embodiments (e.g., having three hydraulic systems), the internal combustion engine (e.g., 275) powers the first hydraulic system, the internal combustion engine powers the second hydraulic system, the internal combustion engine powers the third hydraulic system, or a combination thereof. Further, in a number of embodiments, the vacuum truck (e.g., 170) or vacuum system (e.g., unit 100) includes a debris tank (e.g., 616) that holds the material once excavated and a blower (e.g., 606) that draws air out of the debris tank to create vacuum. Still further, in various embodiments, the vacuum system (e.g., 600) includes the vacuum conduit (e.g., 626) that extends from the debris tank to the excavation site (e.g., 150) where the material is excavated. Even further, in a number of embodiments, the first hydraulic system drives the blower (e.g., 606). Even further, in some embodiments, the compressed air system (e.g., 200) includes an air compressor (e.g., 202) that compresses air delivered to the excavation site where the material is excavated and a compressed air conduit (e.g., 222) that extends from the air compressor to the excavation site where the material is excavated and the second hydraulic system drives the air compressor. In a number of embodiments, the compressed air from the air compressor breaks up the material that is picked up by the vacuum system (e.g., 600). Further, in some embodiments, the third hydraulic system drives (e.g., in addition to the boom) at least one auxiliary system. For example, in some embodiments, the third hydraulic system includes multiple connections (e.g., quick disconnects or quick couplers) to drive at least one auxiliary system external to the vacuum truck (e.g., 170 or vacuum unit 100). Some embodiments provide, for instance, 8-12 gpm of hydraulic power to various power tools (e.g., core drills, trench stabilizers, etc.), for instance, that may be carried on the vacuum truck.

Some embodiments of a vacuum truck (e.g., 170 or unit 100) include a water system (e.g., 400) and one of the (e.g., 3) hydraulic systems drives the water system or a water pump (e.g., 504) within the water system. In some embodiments, for example, a vacuum truck for excavating material includes multiple wheels (e.g., 177), an internal combustion engine (e.g., 275) that provides power to turn at least a subset of the wheels, a vacuum system (e.g., 600) that picks up the material, a boom (e.g., 126) that includes a vacuum conduit (e.g., 626) that extends to an excavation site (e.g., 150) where the material is excavated, a water system (e.g., 400), a first hydraulic system that drives the vacuum system that picks up the material, a second hydraulic system that drives the water system, and a third hydraulic system that drives the boom. Moreover, in some embodiments, a vacuum truck (e.g., 170), for instance, for excavating material includes (e.g., in addition to multiple wheels, an internal combustion engine that provides power to turn at least a subset of the wheels, a vacuum system that picks up the material, a boom that includes a vacuum conduit that extends to an excavation site where the material is excavated, and a water system), an air compressor (e.g., 202), a first hydraulic system that drives the vacuum system that picks up the material, a second hydraulic system that drives the water system (e.g., 400), accessories, and hydraulic controls, and a third hydraulic system that drives the air compressor. Further, in other embodiments, a vacuum truck includes multiple wheels that support the vacuum truck, an internal combustion engine that drives the truck, a vacuum system that picks up the material, a compressed air system, a water system, a first hydraulic system that drives the vacuum system, a second hydraulic system that drives the compressed air system, and a third hydraulic system that drives the water system. In a number of embodiments, the water system (e.g., 400) provides excavation water that breaks up the material that is picked up by the vacuum system (e.g., 600). Further still, in various embodiments, the water system includes a water tank (e.g., 414) that stores excavation water used in the water system and a water conduit (e.g., 424) that extends (e.g., parallel to the vacuum conduit or separately) to the excavation site.

In a number of embodiments, the vacuum unit (e.g., 100) or truck (e.g., 170) controls vacuum or suction pressure (e.g., within vacuum system 600 or conduit 626) by changing rpm of the internal combustion engine (e.g., 275 shown in FIG. 2) and the unit or truck also controls suction pressure by varying a drive ratio of a particular hydraulic system that drives a blower (e.g., 606) within the vacuum system. For example, certain embodiments of a vacuum truck for excavating material include multiple wheels (e.g., 177) that support the vacuum truck, an internal combustion engine that provides power to turn at least a subset of the multiple wheels to drive the vacuum truck, a vacuum system (e.g., 600) that picks up the material, a first hydraulic system that drives the vacuum system that picks up the material, and a suction pressure control system that controls suction pressure within the vacuum system by varying a drive ratio of a the first hydraulic system. In some embodiments, for example, the internal combustion engine powers the first hydraulic system, the first hydraulic system drives a blower (e.g., 606) within the vacuum system, and the drive ratio of the first hydraulic system is a ratio between rotational speed of the internal combustion engine and rotational speed of the blower.

Moreover, various such vacuum trucks (e.g., 170) further include a second hydraulic system, for example, where the internal combustion engine (e.g., 275) powers the second hydraulic system. In some such embodiments, for example, the vacuum truck further includes an air compressor (e.g., 202) and the second hydraulic system drives the air compressor. In a number of embodiments, for instance, the air compressor produces compressed air that breaks up the material that is picked up by the vacuum system (e.g., 600). Further, in some embodiments, the vacuum truck includes a compressed air system (e.g., 200), for example, that includes the air compressor and a compressed air conduit (e.g., 222) that extends from the air compressor to an excavation site (e.g., 150), and the air compressor compresses air that is delivered to an excavation site. Still further, in some embodiments, the vacuum truck includes a water pump (e.g., 504) and the second hydraulic system or a third hydraulic system drives the water pump, in different embodiments. In various embodiments, the water pump pumps excavation water that breaks up the material that is picked up by the vacuum system. Further still, in some embodiments, the vacuum truck includes a water system (e.g., 400) that includes the water pump, and in a number of embodiments, the water system further includes a water tank (e.g., 414) and a water conduit (e.g., 424) that extends from the water pump. Even further still, in some embodiments, the vacuum truck further includes a boom (e.g., 126) that includes a vacuum conduit (e.g., 626) that extends to an excavation site (e.g., 150) where the material is excavated. In some embodiments, the second hydraulic system drives the boom. In other embodiments, however, the third hydraulic system drives the boom.

Some embodiments include a suction relief valve (e.g., 660 shown in FIG. 6). In particular embodiments, for example, a vacuum unit (e.g., 100) or vacuum truck (e.g., 170) for excavating material includes a vacuum system (e.g., 600) that picks up the material and the vacuum system includes the suction relief valve. In some embodiments, for example, the vacuum system includes a debris tank (e.g., 616) that holds the material once excavated, a blower (e.g., 606) that draws air out of the debris tank to create vacuum, a vacuum conduit (e.g., 626) that extends from the debris tank to an excavation site (e.g., 150) where the material is excavated, and a suction pressure control system. In certain embodiments, for instance, the suction pressure control system varies suction pressure, for example, within the vacuum conduit, for instance, continuously over a range of suction pressures. In a number of embodiments, for example, the suction pressure control system includes a suction relief valve connected to the debris tank or to the vacuum conduit, as examples, and the suction relief valve opens to let air into the debris tank or into the vacuum conduit. Further in some embodiments, the suction relief valve is stoppable at any opening of the suction relief valve, for instance, between a fully closed position and a fully open position of the suction relief valve.

As used herein, "stoppable", in this context, means that the operator (e.g., 110) of the vacuum unit (e.g., 100) or truck (e.g., while hand guiding the air and water nozzle, vacuum conduit, boom, or a combination thereof, or while excavating), can stop and set the suction relief valve (e.g., 660) at any opening (e.g., by releasing a suction relief valve control, such as a button, when the suction relief valve is at the desired opening), for instance, within a range of openings (e.g., from fully closed to fully open). Further, as used herein, a system varying pressure "continuously" over a range of pressures means that the operator or system can adjust the pressure to be essentially any pressure within a range of pressures. In contrast, in other embodiments, the suction relief valve is configured so that the operator, for example, while hand guiding the air and water nozzle (e.g., 800) at the excavation site, while breaking up the material that is picked up by the vacuum system (e.g., 600), or both, can (e.g., only) adjust suction pressure to multiple different discrete openings (e.g., with a suction pressure control) to select one of multiple different discrete suction pressures. In various embodiments, for example, there may be 2, 3, 4, 5, 6, 7, 8, 9, 10, 12, 15, or another number of different discrete suction relief valve openings that the operator may be able to choose from, for instance, over a range of openings, and these different openings may each provide a different amount of suction pressure. In a number of embodiments, the actual suction pressure (e.g., at each suction relief valve opening) may depend, for example, on blower speed, airflow rate through the vacuum conduit, or other factors. In a number of embodiments, the suction relief valve opens to atmosphere (e.g., is connected on one side to atmosphere and when the suction relief valve opens, ambient air at atmospheric pressure flows through the valve into the debris tank or vacuum conduit).

In some embodiments, the suction relief valve (e.g., 660) includes a movable plate that moves (e.g., translates) to open and close the suction relief valve. As used herein, "translates" means all particles of a body (e.g., the plate) move with the same velocity along parallel paths (i.e., moves without rotating), at least to within 10 percent. In other embodiments, however, the movable plate rotates to open and close the suction relief valve, for another example. In still other embodiments, the motion of the movable plate is a combination of translation and rotation. Further, in a number of embodiments, the movable plate blocks a round opening to close the suction relief valve. Further still, in various embodiments, the movable plate has a perimeter and includes multiple guide holes through the plate around the perimeter of the movable plate. As used herein, a feature is considered to be at or around a "perimeter" of a component if the feature is within 20 percent of an overall dimension of the component from the perimeter where the overall dimension is perpendicular to the perimeter and where the overall dimension extends through a center of the component. For example, as used herein, guide holes are considered to be "around a perimeter" of a round plate if the guide holes are with 20 percent of the diameter of the plate from the perimeter of the plate. In particular embodiments, however, guide holes are with 5, 10, or 15 percent of the diameter of the plate from the perimeter of the plate, as other examples.

Further, in certain embodiments, the multiple guide holes are equally spaced around the perimeter of the movable plate. As used herein, "equally spaced" means to within 10 percent of the spacing distance. Still further, in various embodiments, the suction relief valve (e.g., 660) includes multiple (e.g., parallel) guide rods, for instance, extending through the multiple guide holes through the movable plate. In different embodiments, for example, there are 4, 5, 6, 7, 8, 9, 10, 11, 12, 13, or 14 guide rods, for instance, extending through an (e.g., equal) number of guide holes. Even further, in some embodiments, the suction relief valve includes a structural stationary plate, for example, that is parallel to the movable plate. In particular embodiments, for instance, the multiple parallel guide rods each attach to the structural stationary plate. Further still, in some embodiments, the suction relief valve includes an actuator, for example, mounted on the structural stationary plate, for instance, that moves the movable plate relative to the structural stationary plate. In certain embodiments, for example, the actuator includes an electric motor (e.g., 12 V DC), an (e.g., externally) threaded elongated member, a gear box, or a combination thereof. In some embodiments, however, the actuator is hydraulic or includes a hydraulic motor or cylinder, as other examples. Even further, in some embodiments, the movable plate is a disk, the structural stationary plate is a disk, or both. As used herein, a "disk" is round to within 15 percent of the average diameter of the disk. In other embodiments, the moveable plate, stationary plate, or both, may be: oval, polygonal, a regular polygon, triangular, square, rectangular, trapezoidal, pentagonal, hexagonal, or octagonal, as other examples, and in some embodiments, may have rounded corners. In some embodiments, the guide holes or guide rods are located at the corners (e.g., of a regular polygon).

In a number of embodiments, the vacuum unit (e.g., 100) includes an excavation nozzle, for example, configured to be hand guided by an operator (e.g., 110) of the vacuum unit at an excavation site (e.g., 150) while excavating the material. The air and water nozzle (e.g., 800) previously described is an example of an excavation nozzle.

In some embodiments, the excavation nozzle includes a suction control, for example, configured to be operated by the operator, for instance, while hand guiding the excavation nozzle and while breaking up the material that is picked up by the vacuum system (e.g., 600). In various embodiments, the suction control opens and closes the suction relief valve (e.g., 660) to control the suction pressure in the vacuum conduit, for instance, continuously over the range of suction pressures. In a number of embodiments, the suction relief valve includes an actuator (e.g., examples of which were described above) that opens and closes the suction relief valve. In certain embodiments, for instance, the actuator includes an electric motor. Other embodiments can differ. In various embodiments, however, the suction control includes a first operable position in which the actuator opens the suction relief valve and a second operable position in which the actuator closes the suction relief valve. In various embodiments, the suction relief valve opens, closes, or both, at a particular fixed rate of speed. In some embodiments, the suction control includes a first operable position in which the electric motor turns in a first direction to open the suction relief valve and a second operable position in which the electric motor turns in a second direction, opposite the first direction, to close the suction relief valve. In various embodiments, the suction control is in the first operable position only when held in the first operable position by the operator (e.g., 110) and the suction control is in the second operable position only when held in the second operable position by the operator. Further, in certain embodiments, the suction control comprises two buttons and the suction control is in the first operable position when and only when the first button is pressed by the operator and the suction control is in the second operable position when and only when the second button is pressed by the operator.

In a number of embodiments, the boom (e.g., 126) of a vacuum truck (e.g., 170) is attached to the remainder of the truck closer to one side of the truck than the other side of the truck. This can, for example, give the boom a greater reach (e.g., in the direction of the one side of the truck). This can be an advantage, for example, in an urban setting where the truck is parked on a street when operated and the boom must reach to the excavation site, or in other circumstance where the vacuum truck must remain a significant distance from the excavation site. In some embodiments, a vacuum truck, for example, for excavating material, includes a front end, a back end opposite the front end, a first side extending from the front end to the back end, a second side opposite the first side, the second side extending from the front end to the back end, a length from the front end to the back end, and a width from the first side to the second side. In a number of embodiments, such a vacuum truck further includes a vacuum system (e.g., 600) that picks up the material, and a boom (e.g., 126) that includes a rotating mount (e.g., 106 shown in FIGS. 1, 6, and 7) and a vacuum conduit (e.g., 626), for example, that extends to an excavation site (e.g., 150) where the material is excavated. In a number of embodiments, for example, the vacuum system that picks up the material includes a debris tank (e.g., 616) that holds the material once excavated and a blower (e.g., 606) that draws air out of the debris tank to create vacuum, and the vacuum conduit is connected to the debris tank. Further, in various such embodiments, the rotating mount (e.g., 106) has a center of rotation that is located on the vacuum truck within a certain percentage of the width from the first side of the vacuum truck. In some embodiments, for instance, the rotating mount has a center of rotation that is located on the vacuum truck within 35 percent of the width from the first side of the vacuum truck.

In different embodiments, the rotating mount (e.g., 106) has a center of rotation that is located on the vacuum truck (e.g., 170) within a percent of the width from the first side of the vacuum truck that can be 40, 30, 25, 20, 15, or 10 percent of the width from the first side of the vacuum truck, as other examples. In some embodiments, the first side of the vacuum truck is the right side (e.g., curbside or passenger side) of the vacuum truck, while in other embodiments, the first side of the vacuum truck is the left side of the vacuum truck. Further, in a number of embodiments, the center of rotation of the rotating mount of the boom (e.g., 126) is located on the vacuum truck within a certain distance (e.g., 30 percent) of the length of the vacuum truck from the back end of the vacuum truck. In various embodiments, for instance, the center of rotation of the rotating mount (e.g., 106) is located on the vacuum truck within a percent of the length from the back end of the vacuum truck that can be 75, 60, 50, 40, 35, 30, 25, 20, 15, or 10 percent of the length from the back end of the vacuum truck, as examples. In a number of embodiments, the boom is mounted at or near the passenger rear corner of the truck (e.g., as shown).

In some embodiments, the vacuum system (e.g., 600) that picks up the material includes a debris tank (e.g., 616) that holds the material once excavated and the rotating mount (e.g., 106) is located on the debris tank. Further, in a number of embodiments, the debris tank includes a first internal support, located inside the debris tank, and the first internal support supports (e.g., along with other components) the load of the boom. The load of the boom can include, for example, the weight of the boom (e.g., 126) as well as moment forces resulting from the boom extending (e.g., cantilevering) outward from the truck (e.g., 170), as well as the weight of any material within the vacuum conduit (e.g., 626) within the boom, the weight of water within the water conduit within the boom (i.e., in embodiments that have a water system and the water conduit is part of the boom); dynamic forces resulting from movement of the boom, movement of the truck, and movement of the material, and forces resulting from the vacuum at the end of the vacuum conduit (e.g., at excavation site 150), among other things.

Further, in some embodiments, the debris tank (e.g., 616) includes a second internal support, located inside the debris tank, that (e.g., also) supports the load of the boom (e.g., 126). Still further, in a number of embodiments, the first internal support includes a first plate, and in particular embodiments, the internal support or the first plate is substantially vertical. As used herein, "substantially", when referring to an angle, means within 15 degrees. Even further, wherever the word "substantially" is used herein, when referring to an angle, other embodiments are contemplated where the angle is within 10 degrees, or within 5 degrees (e.g., of the stated angle or condition). Further still, when an angle is identified herein without using the word "substantially" unless indicated otherwise, the angle is within 10 degrees (e.g., from vertical, horizontal, perpendicular, parallel, tangent, or whatever other angle is indicated). Where a range of angles is provided herein, however, no such tolerance is intended for the endpoint(s) of the range unless the word "substantially" is used to indicate a tolerance of 15 percent. Examples of such ranges include where an angle is indicated to be between two stated angles or where an angle is indicated to be greater than or less than a stated angle. Even further still, in some embodiments, the second internal support includes a second plate, and in particular embodiments, the second internal support or the second plate is substantially vertical. In a number of embodiments, the first internal support, the second internal support, or both, are flat, approximately flat, or substantially flat. In other embodiments, however, the first internal support, the second internal support, or both, are curved. Moreover, in a number of embodiments, the second internal support is substantially perpendicular to the first internal support.

Additionally, in some embodiments, the debris tank (e.g., 616) includes an approximately flat roof. As used herein, "approximately flat" means flat to within one inch over at least 75 percent of any major dimension.) Further, in some embodiments, the debris tank includes a substantially flat roof. As used herein, "substantially flat" means flat to within two inches over at least 90 percent of any major dimension.) Further still, in some embodiments, the debris tank includes a flat roof. As used herein, "flat" (without being preceded by "substantially" or "approximately" means flat to within one inch over at least 100 percent of any major dimension. Unless indicated otherwise, the flatness of the roof (e.g., whether it is flat or approximately or substantially flat) refers to the top surface of the roof. In a number of embodiments, the bottom surface of the roof includes gussets, but the gussets are not considered in determining whether the roof is flat. In various embodiments, the roof of the debris tank forms the top cover of the debris tank (e.g., for at least 75 percent of the area of the top of the tank). In some embodiments, the boom (e.g., 126), vacuum conduit, or other connections may connect to the debris tank at the top of the debris tank (e.g., at the roof of the debris tank). In some embodiments, however, some such connections may be at one or more sides of the debris tank. In a number of embodiments, the (e.g., approximately flat) roof of the debris tank is horizontal or substantially horizontal.

In various embodiments, the vacuum truck (e.g., 170) or the debris tank (e.g., 616) includes a first weir located inside the debris tank. In particular embodiments, for example, the first weir is perpendicular or substantially perpendicular to the (e.g., approximately flat) roof. Further, in certain embodiments, the first weir is vertical or substantially vertical. Still further, in a number of embodiments, the first weir serves as a weir, serves as a structural gusset for vacuum, serves as a substantial structural support for the boom (e.g., as the first internal support or first plate), or a combination thereof (e.g., all three thereof). Even further, in some embodiments, a first weir angle between the first weir and the first side of the vacuum truck is between 10 and 70 degrees. Further still, in particular embodiments, the first weir angle between the first weir and the first side of the vacuum truck is between 15 and 60 degrees, the first weir angle between the first weir and the first side of the vacuum truck is between 18 and 45 degrees, or the first weir angle between the first weir and the first side of the vacuum truck is between 20 and 40 degrees, as examples. Moreover, in some embodiments, the (e.g., approximately flat) roof, further includes multiple first roof gussets, for example, located inside the debris tank. Further, in a number of embodiments, the multiple first roof gussets are each substantially perpendicular to the first weir. Still further, in some embodiments, the multiple first roof gussets are each supported at one end (i.e., one end of each of the multiple first roof gussets) by the first weir. Even further, in particular embodiments, the multiple first roof gussets are each attached to the first weir, for instance, by welding. Further still, in some embodiments, the multiple second roof gussets are located inside the debris tank. Even further still, in certain embodiments, the multiple second roof gussets are each parallel or substantially parallel to the first weir.

In various embodiments, the debris tank (e.g., 616) includes one or more (e.g., multiple) debris walls, for example, that are each flat, approximately flat, or substantially flat, as examples. In a number of embodiments, each of the one or multiple debris walls is at an angle of at least 45 degrees from horizontal. Further, in some embodiments, at least two of the multiple debris walls are at an angle of at least 60 degrees from horizontal. Still further, in particular embodiments, three of the multiple debris walls are at an angle of at least 60 degrees from horizontal. Even further, in certain embodiments, one (or, in some embodiments, at least one) of the multiple debris walls is at an angle of at least 80 degrees from horizontal. In various embodiments, constructing the debris tank with steep walls can help to facilitate removal of the excavated material from the debris tank, for example, through the dump door described in more detail below. Further still, some embodiments include a vibrator that vibrates the debris tank to loosen the material within the debris tank when the material is being removed from the debris tank (e.g., through the dump door). In different embodiments, such a vibrator can be pneumatic, hydraulic, or electric, as examples, and can shake the debris tank, the vacuum truck (e.g., 170) or both, for instance. Even further still, in a number of embodiments, each of the one or multiple debris walls includes multiple external side gussets. In various embodiments, the side gussets are external to facilitate removal of the excavated material from the debris tank. Moreover, in a number of embodiments in which the vacuum unit vacuum unit (e.g., 100) or vacuum truck includes a debris tank that holds the material once excavated, the debris tank includes a top that has internal gussets and at least one side wall that has external gussets.

In some embodiments, the debris tank (e.g., 616) includes a front debris wall, a back debris wall, a first side debris wall, and a second side debris wall. In some embodiments, for example, the back debris wall is opposite the front debris wall, the back debris wall is closer to the back end of the vacuum truck (e.g., 170) than the front debris wall, the first side debris wall extends from the front debris wall to the back debris wall, and the second side debris wall also extends from the front debris wall to the back debris wall and is opposite the first side debris wall. In a number of embodiments, the first side debris wall is closer to the first side of the vacuum truck than the second side debris wall. Further, in various embodiments, at least one of the front debris wall, the back debris wall, the first side debris wall, or the second side debris wall is flat, approximately flat, or substantially flat, as examples. Further still, in some embodiments, at least two of the front debris wall, the back debris wall, the first side debris wall, or the second side debris wall are flat, approximately flat, or substantially flat. Still further, in particular embodiments, at least three of the front debris wall, the back debris wall, the first side debris wall, or the second side debris wall are flat, approximately flat, or substantially flat. Even further, in certain embodiments, the front debris wall, the back debris wall, the first side debris wall, and the second side debris wall are all flat, approximately flat, or substantially flat.

Furthermore, in some embodiments, the front debris wall is at an angle of at least 30 degrees from horizontal. Moreover, in various embodiments, the front debris wall is at an angle of at least 40 degrees from horizontal or at least 35, 45, 50, 55, or 60 degrees from horizontal, as examples. Further, in some embodiments, the front debris wall is at an angle of no more than 60 degrees from horizontal, the front debris wall is at an angle of no more than 55 degrees from horizontal, or the front debris wall is at an angle of no more than 50 degrees from horizontal, as examples. Still further, in a number of embodiments, the first side debris wall is at an angle of at least 30, 35, 40, 45, 50, 55, 60 or 65 degrees from horizontal, as examples. Even further, in some embodiments, the first side debris wall is at an angle of no more than 65, 70, 75, or 80 degrees from horizontal, as examples. Further still, in a number of embodiments, the second side debris wall is at an angle of at least 30, 35, 40, 45, 50, 55, 60 or 65 degrees from horizontal, as examples. Even further still, in some embodiments, the second side debris wall is at an angle of no more than 65, 70, 75, or 80 degrees from horizontal, as examples. Moreover, in some embodiments, the back debris wall is at an angle of at least 30, 35, 40, 45, 50, 55, 60, 65, 70, 75, 80, or 85 degrees from horizontal, as examples. In particular embodiments, for instance, the back debris wall is vertical or substantially vertical.

In a number of embodiments, the vacuum truck (e.g., 170) includes a water tank (e.g., 414). For example, in some embodiments, the vacuum truck includes a water system (e.g., 400) that breaks up the material that is picked up by the vacuum system (e.g., 600), and the water system includes the water tank that stores excavation water used in the water system. Further, in various embodiments, the vacuum truck or the water system includes a water pump (e.g., 504), for example, that pumps the excavation water from the water tank. Still further, a number of embodiments of a vacuum truck or a water system include a water conduit (e.g., 424), for example, that extends (e.g., as shown in FIGS. 1,4, and 5, or in other embodiments, through the boom, for instance, at least partially adjacent to the vacuum conduit) from the water pump to the excavation site (e.g., 150). Even further, in particular embodiments, the water tank (e.g., 414) and the debris tank (e.g., 616) have a common wall (e.g., 417 shown in FIGS. 4 and 7). Further still, in some such embodiments, the common wall includes at least one gusset, for example, located inside the water tank. In certain embodiments, the gusset or gussets are plate, are parallel to each other, are perpendicular to the wall (e.g., 417), or a combination thereof, as examples. In a number of embodiments, the gusset(s) contact or attach to (e.g., are welded to) the (e.g., debris) wall at a horizontal or substantially horizontal line. Even further still, in certain embodiments, the debris tank includes a front debris wall (e.g., as described herein), and the front debris wall of the debris tank is or includes the common wall (e.g., 417). Moreover, in some embodiments, the common wall e.g., 417) is at an angle of at least 40 degrees from horizontal, and in certain embodiments, the common wall is at an angle of at least 45 degrees from horizontal, as examples. To boot, in some embodiments, the common wall e.g., 417) is at an angle of no more than 75 degrees from horizontal, and in particular embodiments, the common wall is at an angle of no more than 70 degrees from horizontal, as examples.

In various embodiments, a vacuum truck (e.g., 170) includes a debris tank (e.g., 616) and a boom (e.g., 126) located on the debris tank. For example, in some embodiments, a vacuum truck for excavating material includes a vacuum system (e.g., 600) that picks up the material, and the vacuum system includes the debris tank (e.g., 616) that holds the material once excavated, a blower (e.g., 606) that draws air out of the debris tank to create vacuum, and a vacuum conduit (e.g., 626) that extends from the debris tank to an excavation site (e.g., 150) where the material is excavated. In a number of such embodiments, the vacuum truck further includes a boom (e.g., 126) that has a rotating mount (e.g., 106) and the boom includes at least a portion of the vacuum conduit that extends to the excavation site where the material is excavated. Further, in particular such embodiments, the rotating mount is located on the debris tank. In a further example, a vacuum truck (e.g., for excavating material) includes a vacuum system and a first weir, for example, located inside the debris tank, which in particular embodiments has a first weir angle between the first weir and a first side of the vacuum truck (e.g., as described herein). Further, in certain embodiments, the first weir angle is between 10 and 70 degrees, for example.

In yet another example, a vacuum truck (for instance, for excavating material) includes a vacuum system (e.g., that picks up the material), a debris tank (e.g., that holds the material once excavated) and the debris tank (e.g., 616) includes certain walls. In a number of embodiments, for example, a vacuum truck (e.g., for excavating material) includes a vacuum system (e.g., that picks up the material), the vacuum system (e.g., 600) including a debris tank that holds the material once excavated, a blower (e.g., 606) that draws air out of the debris tank to create vacuum, and a vacuum conduit (e.g., 626) that extends from the debris tank to an excavation site (e.g., where the material is excavated). Moreover, in a number of such embodiments, the debris tank includes multiple debris walls that are each flat, approximately flat, or substantially flat, as examples. Common wall 417 shown in FIGS. 4 and 7 is an example of a debris wall. Still further, in some embodiments, the debris tank includes multiple side debris walls (e.g., shown in FIGS. 6 and 7) that are each at a particular minimum angle (e.g., at least 45 degrees) from horizontal. Further still, in a number of embodiments, the debris tank includes, for example, a front debris wall, a back debris wall (e.g., common wall 417) opposite the front debris wall (e.g., where the back debris wall is closer to a back end of the vacuum truck (e.g., 170) than the front debris wall), a first side debris wall, and a second side debris wall. FIGS. 6 and 7 illustrate an example. For instance, in some embodiments, the first side debris wall extends from the front debris wall to the back debris wall, the second side debris wall extends from the front debris wall to the back debris wall, the second side debris wall is opposite the first side debris wall, and the first side debris wall is closer to a first side of the vacuum truck than the second side debris wall. Even further, in various embodiments, the debris tank includes multiple side debris walls that each include multiple (e.g., external) side gussets. Further still, in a number of embodiments, the debris tank includes a top that has internal gussets and at least one side wall that has external gussets. Even further still, various embodiments include a water system (e.g., that breaks up the material that is picked up by the vacuum system), the water system (e.g., 400) include a water tank (e.g., 414) that stores excavation water used in the water system, and the water tank and the debris tank have a common wall (e.g., 417).

In a number of embodiments of a vacuum truck (e.g., 170), the debris tank (e.g., that holds the material once excavated) includes a bottom and a dump door at the bottom of the debris tank. In various embodiments, the debris tank is a non-tip tank (i.e., does not tip relative to the remainder of the truck to empty the tank) with a belly dump. As mentioned, in a number of embodiments, this is combined with an integrated water tank (e.g., 414) or a common wall (e.g., 417) with a water tank. Further, in various embodiments, the dump door is opened to remove the material from the debris tank. In particular embodiments, the vacuum truck includes multiple wheels (e.g., 177) that support the vacuum truck, the multiple wheels include at least two front wheels and at least two rearmost wheels, and the dump door is located behind the rearmost wheels (e.g., as shown). Still further, in some such embodiments, the vacuum truck includes an internal combustion engine (e.g., 275 shown in FIG. 2) that provides power to turn at least a subset of the multiple wheels to move the vacuum truck. Further still, in various embodiments, the vacuum truck is configured to be backed over the excavation site (e.g., 150) to dump the material into the excavation site to refill the excavation site. Even further, in certain embodiments, the vacuum truck includes a chassis, the multiple wheels support the chassis and extend below the chassis, the debris tank is supported by the chassis, and the dump door is located below the chassis. Other embodiments, however, may differ as to the location or configuration of the dump door, or both.

In various embodiments, the dump door includes a hinge and the dump door pivots at the hinge to open. Further, in some embodiments, the dump door has a front end and a back end, the front end of the dump door is closer to a front end of the vacuum truck (e.g., 170) than the back end of the dump door, and the dump door is hinged at the front end of the dump door. Still further, in various embodiments, the vacuum truck further includes a dump door hydraulic cylinder that opens and closes the dump door. Even further, in certain embodiments, the dump door hydraulic cylinder is located at the front end of the dump door. Further still, in some embodiments, the dump door has a first top surface and a second top surface. Moreover, in some embodiments, the first top surface, the second top surface, or both, are flat, substantially flat, or approximately flat, as examples. Even further still, in particular embodiments, the first top surface and the second top surface are at an obtuse angle (i.e., relative to each other).

Furthermore, in certain embodiments, the first top surface and the second top surface are at a dump door surface angle of less than 170, 160, 150, or 140 degrees, as examples. Moreover, in particular embodiments, the dump door surface angle is greater than 100, 110, 120, or 130 degrees, as examples. Further, in various embodiments, the dump door includes a curved surface. For example, in some embodiments, the first top surface and the second top surface of the dump door are separated by the third dump door surface (e.g., that is a curved surface). For instance, in various embodiments, the curved surface of the dump door is concave upward (e.g., when the dump door is closed). Still further, in certain embodiments, the first top surface and the second top surface of the dump door are tangent or substantially tangent to or with the curved surface of the dump door. In various embodiments, for example, the first top surface of the dump door is (e.g., substantially) tangent with the curved surface of the dump door where the first top surface of the dump door abuts the curved surface of the dump door. Similarly, in a number of embodiments, the second top surface of the dump door is (e.g., substantially) tangent with the curved surface of the dump door where the second top surface of the dump door abuts the curved surface of the dump door.

Moreover, in a number of embodiments, the dump door is horizontal when closed. For example, in some embodiments, an axis of curvature of the curved surface (e.g., the third surface) is horizontal when the dump door is closed. For another example, in some embodiments, a side of the dump door (e.g., parallel to the first side or second side of the vacuum truck or both) is horizontal when the dump door is closed. For yet another example, in some embodiments, a line that forms an intersection of the first top surface and the second top surface of the dump door is horizontal when the dump door is closed. Further, in a number of embodiments, the dump door moves downward to open. For example, in various embodiments, the dump door pivots or rotates downward about the hinge when the dump door opens.

In other embodiments, however, including the embodiment shown, the dump door (e.g., 199 shown in FIGS. 1, 6, and 7) is substantially vertical when closed and the dump door is hinged at the top of the dump door and opens by rotating horizontally and then upward. In the embodiment shown, the vacuum truck (e.g., 170) includes a dump door hydraulic cylinder that opens and closes the dump door. Even further, in the embodiment illustrated, the dump door hydraulic cylinder is located at the rear end of the dump door. In the embodiment shown, the truck can be backed up to the excavation site, or another location, to dump the excavated material (e.g., that was picked up by vacuum system 600).

Other embodiments include an apparatus (e.g., including or other than a vacuum truck) that includes a novel combination of the features described herein (e.g., a nozzle with certain features described herein). Further embodiments include various methods of excavating material that include a novel combination of the features described herein. Still other embodiments include various methods of obtaining or providing a vacuum truck (e.g., 170), where such a method includes acts of obtaining or providing a novel combination of the features described herein. Even further embodiments include a vacuum truck that includes at least one means for accomplishing at least one functional aspect described herein. Moreover, various embodiments include certain (e.g., combinations of) structural aspects described herein. All novel combinations are potential embodiments. Some embodiments may include a subset of elements described herein and various embodiments include additional elements as well.

Further, various embodiments of the subject matter described herein include various combinations of the acts, structure, components, and features described herein, shown in the drawings, described in any documents that are incorporated by reference herein, or that are known in the art. Moreover, certain procedures can include acts such as manufacturing, obtaining, or providing components that perform functions described herein or in the documents that are incorporated by reference. The subject matter described herein also includes various means for accomplishing the various functions or acts described herein, in the documents that are incorporated by reference, or that are apparent from the structure and acts described. Each function described herein is also contemplated as a means for accomplishing that function, or where appropriate, as a step for accomplishing that function. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. An apparatus comprising:

an air and water nozzle comprising:

a first tube;
a second tube;
a first exit orifice from a first space inside the first tube; and
two second exit orifices from a second space inside the second tube;
a water system that delivers water to the air and water nozzle; and
a compressed air system that delivers compressed air to the air and water nozzle;
wherein:
water passes through the first space from a first end of the air and water nozzle to the first exit orifice at a second end of the air and water nozzle opposite the first end;
air passes through the second space from the first end of the air and water nozzle to the second exit orifices at the second end of the air and water nozzle; and
the air and water nozzle is configured so that an operator, while hand guiding the air and water nozzle, can select between:
delivering compressed air only from the second exit orifices;
delivering water only from the first exit orifice; and
delivering compressed air only from the second exit orifices and delivering water only from the first exit orifice.

2. The apparatus of claim 1 wherein the first tube is concentric with the second tube.

3. The apparatus of claim 1 wherein the second space is between the first tube and the second tube.

4. The apparatus of claim 1 wherein the apparatus further comprises a vacuum system.

5. The apparatus of claim 4 wherein the vacuum system comprises:
a tank that holds material that has been picked up by the vacuum system;
a blower that draws air out of the tank to create vacuum; and
a vacuum conduit that extends from the tank to a site where the material is picked up by the vacuum system.

6. The apparatus of claim 5 wherein the air and water nozzle is used to break up the material at the site where the material is picked up by the vacuum system.

7. The apparatus of claim 1 wherein the two second exit orifices and the first exit orifice are arranged in a line with the first exit orifice in between the two second exit orifices at the second end of the air and water nozzle.

8. The apparatus of claim 1 wherein the first tube is inside the second tube.

9. The apparatus of claim 8:
wherein the second space is between the first tube and the second tube.

10. The apparatus of claim 8 wherein the apparatus further comprises a vacuum system.

11. The apparatus of claim 10 wherein the vacuum system comprises:
a tank that holds material that has been picked up by the vacuum system;
a blower that draws air out of the tank to create vacuum; and
a vacuum conduit that extends from the tank to a site where the material is picked up by the vacuum system.

12. The apparatus of claim 11 wherein the nozzle is used to break up the material at the site where the material is picked up by the vacuum system.

13. A vacuum unit for excavating material, the vacuum unit comprising:
a vacuum system;
a compressed air system;
a water system;
an air and water nozzle configured to be hand guided by an operator of the vacuum unit while excavating the material, the air and water nozzle comprising:
a body that is hand held by the operator while excavating the material;
an air passageway through the body wherein compressed air passes through the air passageway when being used to break up the material;
at least one air exit orifice from the air passageway through the body wherein the compressed air passes through the at least one air exit orifice from the air passageway when the compressed air is being used to break up the material;
a water passageway through the body wherein excavation water from the water system passes through the water passageway when the excavation water is being used to break up the material;
at least one water exit orifice from the water passageway through the body wherein the excavation water passes through the at least one water exit orifice from the water passageway when the excavation water is being used to break up the material;
an air valve wherein the compressed air passes through the air valve when the compressed air is being used to break up the material;
a water valve wherein the excavation water passes through the water valve when the excavation water is being used to break up the material;
an air control that opens and closes the air valve; and
a water control that opens and closes the water valve;
wherein:
the air and water nozzle is configured so that the operator, while hand guiding the air and water nozzle, can use the air control and the water control to select between:
delivering the compressed air only from the air exit orifice;
delivering the water only from the water exit orifice; and
delivering both the compressed air from the air exit orifice and delivering the water from the water exit orifice;
the air control is configured to be operated by the operator while hand guiding the air and water nozzle and while breaking up the material; and
the water control is configured to be operated by the operator while hand guiding the air and water nozzle and while breaking up the material.

14. The vacuum unit of claim 13 wherein the air and water nozzle is configured so that the operator, while hand guiding the air and water nozzle at the excavation site, and while breaking up the material, can continuously adjust flow rate of the excavation water with the water control.

15. The vacuum unit of claim 13 wherein the at least one air exit orifice from the air passageway through the body comprises two air exit orifices from the air passageway through the body.

16. The vacuum unit of claim 15 wherein the two air exit orifices from the air passageway through the body and the at least one water exit orifice from the water passageway through the body are arranged in a line with the at least one water exit orifice from the water passageway through the body between the two air exit orifices from the air passageway through the body.

17. The vacuum unit of claim 13 wherein the water passageway through the body is inside the air passageway through the body.

18. The vacuum unit of claim 13 wherein the water passageway through the body is concentric with the air passageway through the body.

19. The vacuum unit of claim 13 wherein the vacuum system comprises:

a tank that holds material that has been picked up by the vacuum system;

a blower that draws air out of the tank to create vacuum; and a vacuum conduit that extends from the tank to a site where the material is picked up by the vacuum system.

20. The vacuum unit of claim 19 wherein the air and water nozzle is used to break up the material at the site where the material is picked up by the vacuum system.

* * * * *